US008524436B2

(12) United States Patent
Nagayama et al.

(10) Patent No.: US 8,524,436 B2
(45) **Date of Patent: *Sep. 3, 2013**

(54) DEVELOPING DEVICE, IMAGE FORMING METHOD AND APPARATUS, AND PROCESS CARTRIDGE

(75) Inventors: Masashi Nagayama, Shizuoka (JP); Mitsuo Aoki, Shizuoka (JP); Hideyuki Santo, Shizuoka (JP); Shigenori Yaguchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 170 days.

This patent is subject to a terminal disclaimer.

(21) Appl. No.: 13/168,385

(22) Filed: Jun. 24, 2011

(65) Prior Publication Data

US 2012/0009518 A1 Jan. 12, 2012

(30) Foreign Application Priority Data

Jul. 7, 2010 (JP) ..... 2010-155192
Apr. 1, 2011 (JP) ..... 2011-081534

(51) Int. Cl.
*G03G 5/00* (2006.01)

(52) U.S. Cl.
USPC ..... 430/123.53; 430/124.1; 430/111.4

(58) Field of Classification Search
USPC ..... 430/123.53, 124.7, 111.4, 124.1, 430/111.41; 399/252, 258
See application file for complete search history.

(56) References Cited

U.S. PATENT DOCUMENTS 5,260,753 A 11/1993 Haneda et al.
5,915,144 A 6/1999 Ide et al.
7,150,954 B2 12/2006 Aoki et al.
7,183,029 B2 2/2007 Masuda et al.
7,468,233 B2 12/2008 Nagayama et al.
7,522,857 B2 4/2009 Hasegawa et al.
2005/0277046 A1 12/2005 Sawada et al.
2006/0068306 A1 3/2006 Shu et al.
2008/0199223 A1 8/2008 Tateyama et al.

(Continued)

FOREIGN PATENT DOCUMENTS

JP 4-278967 10/1992
JP 5-158364 6/1993

(Continued)

OTHER PUBLICATIONS

Extended European Search Report issued Apr. 2, 2012, in Patent Application No. 11172845.7.

(Continued)

*Primary Examiner* — Mark A Chapman
(74) *Attorney, Agent, or Firm* — Oblon, Spivak, McClelland, Maier & Neustadt, L.L.P.

(57) ABSTRACT

In the image forming method, a color toner image and a transparent toner image are formed using a first developing device containing a first developer including color toner and carrier, and a second developing device containing a second developer including transparent toner and carrier. At least the second developing device includes a developer bearing member bearing the second developer for developing an electrostatic image; a developer supplying passage supplying the developer to the developer bearing member while feeding the developer in a first direction; and a developer feeding passage separated from the developer supplying passage at a central portion thereof and feeding the developer used for development in a direction parallel to the first direction. The transparent toner includes a resin and a lubricant and has viscoelastic property such that loss tangent has a peak with height of not less than 3 at a temperature of from 80° C. to 160° C.

14 Claims, 14 Drawing Sheets

(56) References Cited

U.S. PATENT DOCUMENTS

| | | | |
|---|---|---|---|
| 2008/0213682 | A1 | 9/2008 | Saitoh et al. |
| 2009/0074450 | A1 | 3/2009 | Nagayama et al. |
| 2009/0123857 | A1 | 5/2009 | Shu et al. |
| 2009/0291380 | A1 | 11/2009 | Ayaki et al. |
| 2010/0068644 | A1 | 3/2010 | Nakajima et al. |
| 2010/0136471 | A1 | 6/2010 | Yamada et al. |
| 2010/0216066 | A1 | 8/2010 | Kadokura et al. |

FOREIGN PATENT DOCUMENTS

| | | |
|---|---|---|
| JP | 9-200551 | 7/1997 |
| JP | 2750105 | 2/1998 |
| JP | 3030576 | 2/2000 |
| JP | 3146367 | 1/2001 |
| JP | 2009-109926 | 5/2009 |

OTHER PUBLICATIONS

Office Action issued on Apr. 11, 2013, in corresponding European Application No. 11 172 845.7 (4 pages).

DEVELOPING DEVICE

DEVELOPING DEVICE, IMAGE FORMING METHOD AND APPARATUS, AND PROCESS CARTRIDGE

BACKGROUND OF THE INVENTION

1. Field of the Invention

The present invention relates to a developing device for developing an electrostatic latent image with a two-component developer. In addition, the present invention relates to an image forming method, an image forming apparatus, and a process cartridge using the developing device.

2. Description of the Related Art

Electrophotographic image forming methods used for dry image forming apparatuses such as laser printers, copiers and facsimiles typically include the following processes:

(1) charging the surface of an image bearing member such as a photoreceptor (charging process);

(2) irradiating the charged image bearing member with light so that the charges of the irradiated portions decay, thereby forming an electrostatic latent image on the image bearing member (irradiating process);

(3) developing the electrostatic latent image with a developer including a charged dry toner to form a visible toner image on the image bearing member (developing process);

(4) transferring the toner image to a recording material such as a paper sheet (transferring process);

(5) fixing the toner image to the recording material upon application of heat and/or pressure (fixing process); and (6) cleaning the surface of the image bearing member so that the image bearing member is ready for the next image forming operation.

Recently, there is an increasing need for an image forming apparatus capable of performing high speed image formation while saving fixing energy. Therefore, toner capable of melting at a relatively low temperature is needed. Since a low temperature fixable toner has such a property as to be easily melted, the low temperature fixable toner is preferably used as a transparent toner because a glossy image can be formed with low fixing energy. However, when a low temperature fixable toner is prepared merely by decreasing the melting point of the toner, the toner tends to cause a problem in that the preservability of the toner deteriorates. In addition, when the toner is used for a two-component developer, the toner tends to cause a spent toner problem in that the toner adheres to the surface of the carrier when the developer is agitated in a developing device, thereby deteriorating the charging ability of the carrier.

Further, recent image forming apparatuses are required to produce high quality images, and when a pictorial image is formed, a technique in that high glossiness is imparted to the surface of a recording material is used to produce a clear glossy image.

In order to impart high glossiness to the surface of a recording material, a technique in that a transparent toner is applied to a non-image area of a color image on a recording material to decrease the difference in glossiness between the color image area and the non-image area; a technique in that a transparent toner is applied to the entire surface of a recording material; and the like, have been proposed. In addition, a technique in that a color toner image and a transparent toner image are formed on a recording material, and the images are heated by a fixing device, followed by cooling and peeling from the fixing device to prepare a glossy image is proposed. Using these techniques make it possible to produce copies having little difference in glossiness between an image area and a non-image area.

By contrast, in the printing field, treatments such as UV varnish printing, varnishing, and polypropylene film laminating are performed to control the glossiness of a desired portion of a printed recording material. For example, a technique in that after performing a usual printing operation, an additional spot printing operation is performed on a desired portion of the print using an additionally prepared plate and a UV varnish or the like to impart high glossiness to the portion is used. By using this technique, a print in which the portion subjected to the spot printing operation has as high glossiness as photographs and other portions thereof have relatively low glossiness can be produced. Namely, the print has large glossiness difference, and therefore the print can be differentiated from normal prints.

However, when such a print is produced using an offset printing method, it is necessary to prepare an additional plate for forming such a glossy portion. In addition, this method cannot be used for producing a small number of prints due to increase of running costs, i.e., the method can be used only for producing a large number of prints. Since electrophotography can perform image formation without using a plate, it becomes possible to produce such prints even when the number of the prints is small.

In attempting to produce images having different glossiness using electrophotography, a method in which a color toner image is formed on a recording material using at least one color toner (such as yellow, magenta or cyan toner) and a transparent toner, wherein an image portion having the transparent toner image has glossiness different from the glossiness of the color image portion by ±20% or more due to difference of the melting points of the color toner and the transparent toner; a method in which after a fixed color toner image is formed, an image is formed using a transparent toner while decreasing the fixing temperature to prepare an image portion having high glossiness and another image portion having relatively low glossiness; and a method in which initially a fixed glossy image is formed and then a non-glossy image is formed, followed by fixing, have been proposed. By using these methods, a copy having portions with different glossiness can be produced, but the glossiness of a glossy image portion of the copy is lower than the glossy portion of a pictorial print formed by the above-mentioned spot printing method.

One of background developing devices using a two-component developer including a toner and a magnetic carrier is illustrated in FIG. 1. Referring to FIG. 1, a background developing device 4*a* has two separated developer passages, i.e., a first developer passage (i.e., a developer supplying passage) for supplying a developer to a developing roller 5 (serving as a developer bearing member) and a second developer passage 10 (i.e., a developer agitating passage) for agitating the developer. The developer in the first developer passage is fed in a direction opposite to the feeding direction of the developer in the second developer passage 10 so that the developer is circulated in the two developer passages. In FIG. 1, numerals 401, 403 and 11 denote a first auger for feeding the developer in the first developer passage, a partition, and a second auger for agitating the developer in the second developer passage.

In the background developing device illustrated in FIG. 1, the first developer passage for supplying the developer to the developing roller 5 also serves as a developer collecting passage for collecting the developer passing through a development region so as to be used for developing electrostatic latent images on an image bearing member. Therefore, the concentration of toner in the developer decreases in the developer feeding direction in the first developer passage. Namely, the developer on the downstream side of the first developer passage relative to the developer feeding direction has lower toner concentration than the developer on the upstream side. Therefore, a problem in that images having uneven image density are formed is caused.

In attempting to avoid such an uneven density image problem, there are proposals for developing devices in which a developer supplying auger and a developer collecting auger for collecting the developer, which has been used for development, are arranged in different developer passages. Hereinafter, each of the background developing devices will be explained in detail.

One of the background developing devices is illustrated in FIG. 2. Referring to FIG. 2, another background developing device 4*b* includes a developer supplying passage 9 for supplying a developer to the developing roller 5, and a developer collecting passage 7 for collecting the developer passing through a development region at which the developing roller 5 is opposed to an electrostatic latent image bearing member 1, wherein the developer collecting passage 7 is separated from the developer supplying passage 9. Since the developer passing through the development region is fed to the developer collecting passage 7, the developer is not mixed with the developer in the developer supplying passage 9. Therefore, the toner concentration of the developer in the developer supplying passage 9 (i.e., the toner concentration of the developer fed to the developing roller 5) hardly changes.

However, the collected developer fed to the developer collecting passage 7 is supplied to the developer supplying passage 9 shortly after the developer is collected and a fresh toner is supplied to the collected developer (this developer is hereinafter sometimes referred to as a recovered developer). Therefore, even when the recovered developer has a proper toner concentration, problems in that uneven density images or low density images are produced occur. This is because the recovered developer (i.e., the mixture of the collected developer and the fresh toner) is not sufficiently agitated. The problems are remarkably caused when the developer has been used for developing images having a high image area proportion and the collected developer has a relatively low toner concentration. In FIG. 2, numerals 8, 6 and 209 denote first, second and third augers, and numerals 15 and 16 denote a center of the developing roller 5 and a developer thickness controlling member for controlling the thickness of the developer on the developing roller 5.

Another background developing device is illustrated in FIG. 3. In a background developing device 4*c* illustrated in FIG. 3, a developer supplying passage 9 for supplying a developer to a developing roller 5 is separated from a developer collecting passage 7 for collecting the developer passing through the development region at which the developing roller 5 is opposed to an electrostatic latent image bearing member 1. The developing device 4*c* further includes a developer agitating passage 10, which receives the developer, which has been fed to the downmost stream side of the developer supplying passage 9, and the collected developer, which has been fed to the downmost stream side of the developer collecting passage 7, to agitate the developers while feeding the mixed developer in the direction opposite to the developer feeding direction in the developer supplying passage 9.

In the developing device 4*c*, the developer used for development is fed to the developer collecting passage 7, and therefore the collected developer is not mixed with the developer in the developer supplying passage 9. Therefore, the toner concentration of the developer in the developer supplying passage 9 (i.e., the toner concentration of the developer fed to the developing roller 5) hardly changes.

In the developing device 4*c*, the collected developer is mixed with the developer fed through the developer supplying passage 9 without being used for development, and the mixed developer is agitated in the developer agitating passage 10. The mixed developer is then supplied to the developer supplying passage 9. Therefore, the above-mentioned problems in that uneven density images or low density images are produced are hardly caused. In FIG. 3, numerals 404, 405 and 27 denote a partition, another partition and a toner sensor for detecting the concentration of toner in the developer in the developer agitating passage 10.

The above-mentioned proposals have been made for a development operation using a color toner because it is described in the proposals that the purpose thereof is to stabilize the image density, and are not made for a development operation which uses a transparent toner to produce a glossy image portion while stabilizing the glossiness of the image.

For these reasons, the present inventors recognized that there is a need for an image forming method by which highly glossy images can be stably produced using a developer including a color toner and a carrier and another developer including a low temperature fixable transparent toner and a carrier without causing the hot offset problem and the high temperature preservability problem.

SUMMARY

This patent specification describes a novel developing device for developing an electrostatic latent image on an image bearing member. The developing device includes:

a developer bearing member to bear a developer including a transparent toner and a magnetic carrier to develop the electrostatic latent image on the image bearing member with the transparent toner at a development region in which the developer bearing member is opposed to the image bearing member, wherein the transparent toner includes a resin and a lubricant, and has a viscoelastic property such that a loss tangent (tan δ), which is defined as a ratio (G"/G') of loss modulus (G") to storage modulus (G'), has a peak at a temperature of from 80° C. to 160° C. and the peak has a height of not less than 3;

a developer supplying passage having a developer supplying member to feed the second developer in a first direction parallel to an axial direction of the developer bearing member to supply the second developer to the developer bearing member; and a developer feeding passage having a developer feeding member to feed at least the developer, which has passed through the development region and is fed to the developer feeding passage, in a second direction parallel to the first direction, wherein the developer feeding passage is separated with a partition from the developer supplying passage at least at a central portion thereof in the first and second directions.

This patent specification describes a novel image forming method for producing at least one color toner image and a transparent toner image on a recording material, wherein the color toner image and the transparent toner image are partially or entirely overlapped.

The image forming method includes:

developing an electrostatic latent image on a first image bearing member with a first developer, which includes a color toner and a first magnetic carrier and which is contained in a first developing device, to form a color toner image on the first image bearing member;

developing another electrostatic latent image on the first image bearing member or a second image bearing member with a second developer, which includes a transparent toner and the first magnetic carrier or a second magnetic carrier and which is contained in a second developing device, to form a transparent toner image on the first or second image bearing member;

transferring the color toner image and the transparent toner image onto a recording material to form a combined toner image in which the color toner image and the transparent toner image are partially or entirely overlapped; and fixing the combined toner image on the recording material.

At least the second developing device is the developing device mentioned above.

This patent specification describes a novel image forming apparatus including at least one image bearing member; a first developing device to develop an electrostatic latent image on the image bearing member with a first developer including a color toner and a magnetic carrier to form a color toner image on the image bearing member; a second developing device, which is the above-mentioned developing device and which develops an electrostatic latent image on the image bearing member with a second developer including the above-mentioned transparent toner and a magnetic carrier to form a transparent toner image on the image bearing member; a transferring device to transfer the color toner image and the transparent toner image onto a recording material so that the color toner image and the transparent toner image are partially or entirely overlapped; and a fixing device to fix the toner images on the recording material.

This patent specification describes—a novel process cartridge including an image bearing member to bear an electrostatic latent image, and the above-mentioned developing device containing a developer including the above-mentioned transparent toner and a magnetic carrier to develop the electrostatic latent image with the developer. The image bearing member and the developing device are integrated into a single unit so as to be detachably attachable to an image forming apparatus.

BRIEF DESCRIPTION OF THE DRAWINGS

A more complete appreciation of aspects of the invention and many of the attendant advantage thereof will be readily obtained as the same become better understood by reference to the following detailed description when considered in connection with the accompanying drawings, wherein.

DESCRIPTION OF THE PREFERRED EMBODIMENTS

Figure 1:
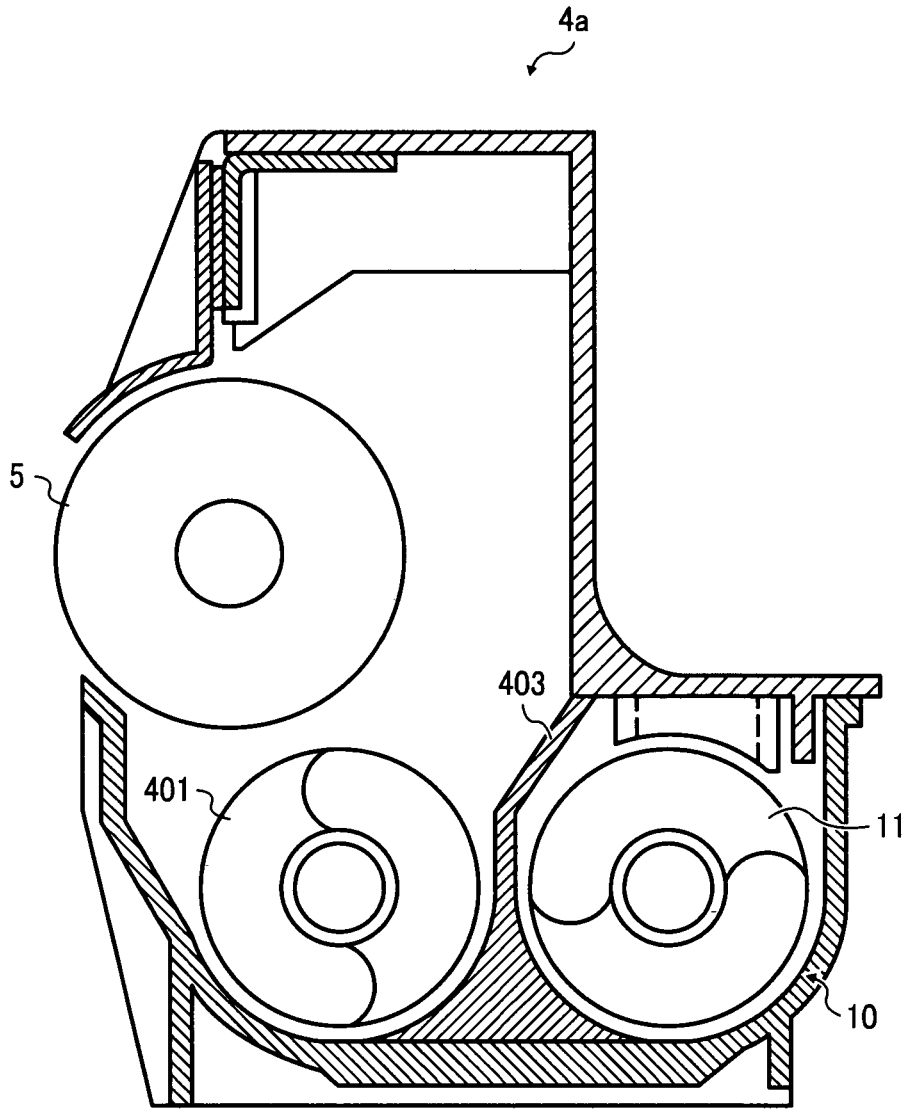
FIG. 1 RELATED ART
FIGS. 1-3 are schematic cross-sectional views illustrating background developing devices.
Figure 2:
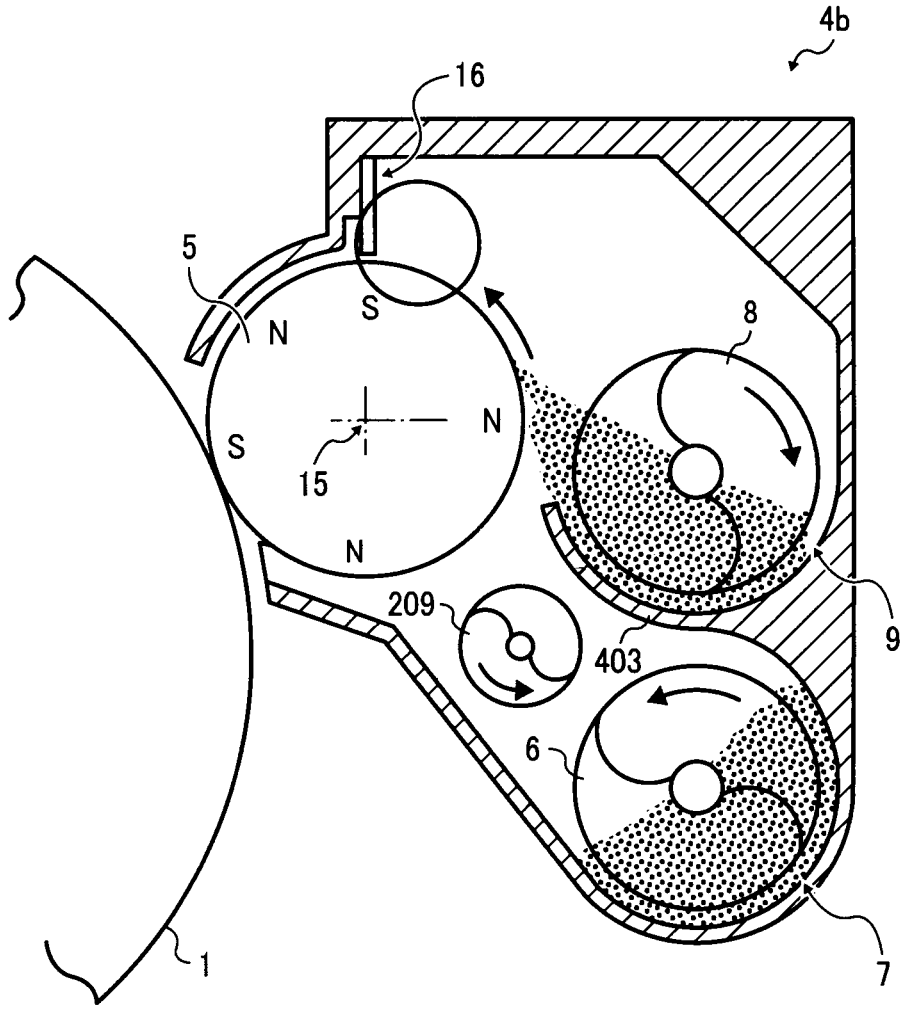
FIG. 2 RELATED ART
Figure 3:
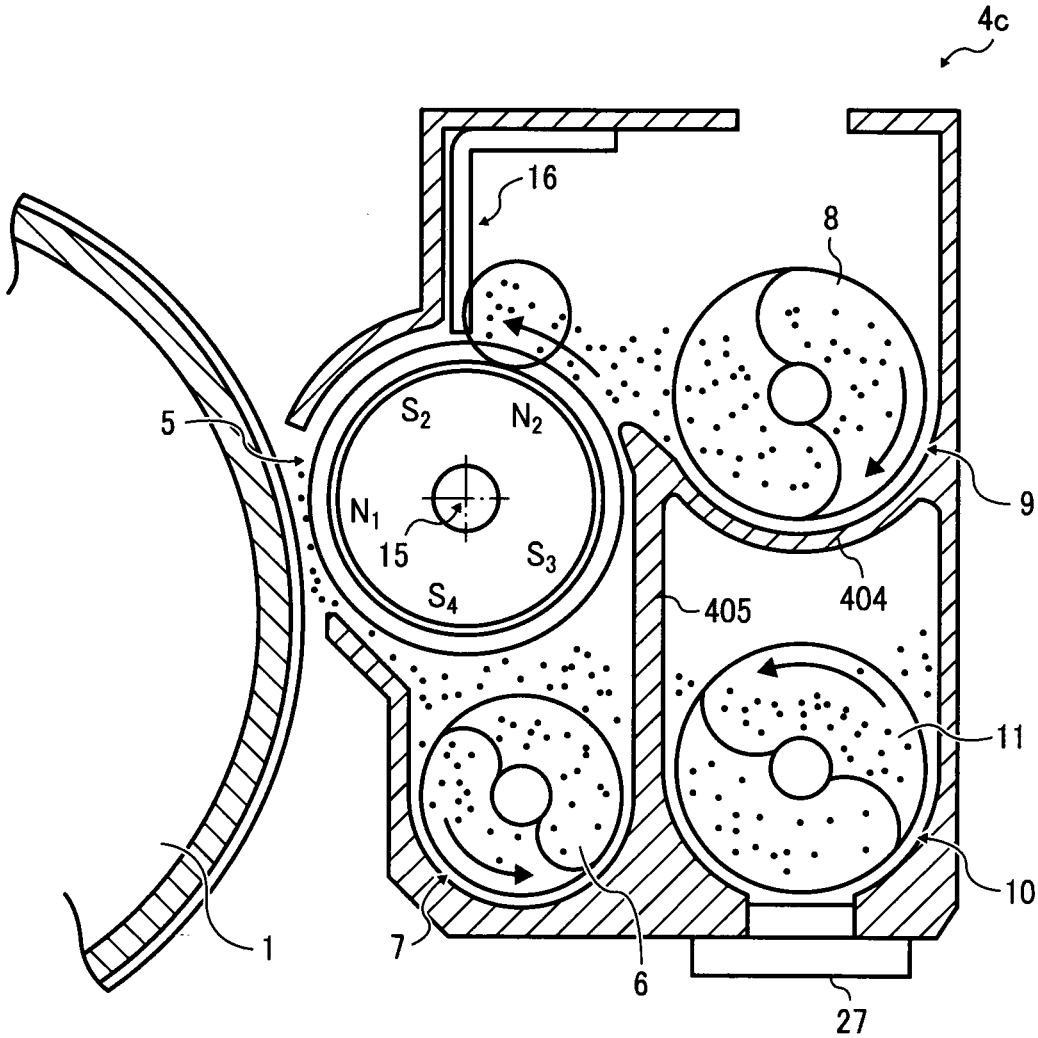
FIG. 3 RELATED ART

The present invention will be described in detail.

As a result of the present inventors' investigation, it is discovered that highly glossy images can be produced at a low fixing temperature without causing the hot offset problem and the high temperature preservation problem by an image forming apparatus having an image bearing member, and the below-mentioned developing device to develop an electrostatic latent image on the image bearing member using a developer including a transparent toner and a magnetic carrier to form a transparent toner image on the image bearing member, wherein the transparent toner includes a resin and a lubricant, and has a viscoelastic property such that a loss tangent (tan δ), which is defined as a ratio (G"/G') of loss modulus (G") thereof to storage modulus (G') thereof, has a peak of not less than 3 at a temperature of from 80° C. to 160° C.

The developing device includes a developer bearing member to bear thereon the developer, which includes the transparent toner and a magnetic carrier, to develop an electrostatic latent image on the image bearing member with the toner at a development region in which the developer bearing member is opposed to the image bearing member; a developer supplying passage having a developer supplying member to feed the developer in a first direction parallel to an axial direction of the developer bearing member to supply the developer to the developer bearing member; a developer collecting passage having a developer collecting member to collect the developer, which has passed through the development region, while feeding the developer in the first direction; and a developer agitating passage having a developer agitating member to feed a mixture of the developer, which is fed to a downmost stream side of the developer supplying passage without being used for developing the electrostatic latent image, and the developer, which has been collected and fed to a downmost stream side of the developer collecting passage, in a second direction opposite to the first direction while agitating the mixed developer, wherein the developer supplying passage, the developer collecting passage, and the developer agitating passage are separated with partitions from each other at least at central portions thereof (i.e., the developer supplying passage, the developer collecting passage and the developer agitating passage are connected at least at an end (i.e., the downmost stream side of the developer supplying passage), and the developer supplying passage is located over the developer collecting passage and the developer agitating passage while the developer collecting passage and the developer agitating passage are located on substantially the same level in the vertical direction.

Alternatively, the developing device may be a developing device including the above-mentioned developer bearing member to bear thereon the developer; the above-mentioned developer supplying passage; and a developer agitating passage having a developer agitating member to feed the developer, which has been fed to a downmost stream side of the developer supplying passage without being used for developing the electrostatic latent image, in the second direction opposite to the first direction while agitating the mixed developer, wherein the developer agitating passage is separated with a partition from the developer supplying passage at least at central portions thereof (i.e., except for at least both end portions thereof in the first and second directions), and the developer passing through the development region is collected by the developer agitating passage and then mixed with the developer fed by the developer agitating member so that the mixed developer is fed to the developer supplying passage.

Specifically, a developing device having two passages including a supplying passage (first passage) having a supplying member, and an agitating passage (second passage) having an agitating member; or a developing device having three passages including a supplying passage (first passage) having a supplying member, an agitating passage (second passage) having an agitating member, and a collecting passage (third passage) including a collecting/feeding member, can be used as the developing device of the image forming apparatus of the present invention.

In both the developing devices, the developer fed by the supplying member and passing through the developing region is not directly returned to the supplying passage, and is fed to the agitating passage optionally via the collecting passage so as to be agitated. The agitated developer is then fed to the supplying passage. These developing devices are referred to as one-way circulation developing devices. The developing device having two passages is referred to as a biaxial one-way circulation developing device, and the developing device having three passages is referred to as a triaxial one-way circulation developing device. In both the developing devices, the developer fed through the supplying passage without supplied to the development region is mixed with the developer, which passes through the development region and is collected by the agitating passage or the collecting passage, in the agitating passage, and the mixed developer is then fed to the supplying passage.

Since the image forming apparatus uses one of the above-mentioned developing devices, the developer used for development and having a relatively low toner concentration is not mixed with the developer in the supplying passage. Therefore, an uneven toner image problem in that the weight of a toner image varies due to variation of the toner concentration of the developer used for development is hardly caused. Namely, a transparent toner image having a desired thickness can be stably formed on a recording material, thereby stably forming images having a desired glossiness.

Biaxial one-way circulation developing devices have an advantage such that after a supplementary toner is supplied to the developing device, the supplementary toner can be rapidly dispersed in the developer in the developing device. Therefore, the uneven toner image problem is hardly caused.

When a supplementary toner is supplied to the developer circulated in a developing device, the toner is not evenly dispersed (i.e., the developer includes a portion including the toner at a high concentration, and a potion including the toner at a low concentration), just after the supplementary toner is added. In order to avoid the problem, it is preferable that the added supplementary toner is rapidly dispersed in the entire developer in the developing device.

In conventional developing devices which have only a developer supplying passage and a developer agitating passage and which has such a structure as illustrated in FIG. 1, the circulation length of the developer is predetermined. Therefore, when a supplementary toner is supplied to the developer at a point in the circulation path, a relatively long time is needed until the supplementary toner is fed to a farthest point from the toner supply point, i.e., a relatively long time is needed until the toner well mixed with the developer in the developing device. Therefore, in the toner mixing process, in which the supplementary toner is not well mixed with the developer in the developing device, uneven density images tend to be produced.

By contrast, in one-way circulation developing devices, particularly in biaxial one-way circulation developing devices, the developer passing through the development region is mixed with the developer, which has been fed to the downmost stream side of the developer supplying passage without being used for development, in the entire portion of the developer agitating passage. Therefore, the developer passing through the development region and the developer, which is not used for developing, can be well mixed, and thereby occurrence of the uneven density image problem can be prevented.

In addition, the biaxial one-way circulation developing device includes no developer collecting passage, and therefore the developing device can be miniaturized.

The transparent toner for use in the image forming method of the present invention includes a resin having a viscoelastic property such that a loss tangent (tan δ), which is defined as a ratio (G"/G') of loss modulus (G") thereof to storage modulus (G') thereof, has a peak at a temperature of from 80° C. to 160° C. and the peak has a height of not less than 3. The resin is preferably a polyester resin.

In order that the transparent toner produces an image having a high glossiness while being fixed at a relatively low temperature, the toner preferably has a property such that the storage modulus (G') thereof suddenly decreases sharply from a certain temperature (i.e., a melting temperature at which the resin constituting the transparent toner changes its state from a glass state to a liquid state via a rubber state). When the toner has such a property, the transparent toner can easily enter into recessed portions of a rough paper serving as a recording material and microscopic recessed portions of a color toner image (such as yellow, magenta and cyan images), on which the transparent toner image is to be formed, while having good ductility. In this regard, it is preferable for the toner that the storage modulus (G') thereof hardly decreases (i.e., does not sharply decrease) after the resin has a certain viscosity. In this regard, it is preferable for the toner in view of hot offset resistance that the loss modulus (G") thereof sharply decreases from the temperature even though the decreasing rate of the loss modulus (G") is not sharper than that of the storage modulus (G').

Unless the storage modulus (G') sharply decreases from a certain temperature and the compliance with an external sinusoidal stress has a maximal value in a certain temperature range (i.e., the resin is not sensitive to an external sinusoidal stimulation, namely there is no maximal output loss in the imaginary part of the calculating formula used for determining the viscoelastic property), there is no peak in the loss tangent curve.

Only a toner having such a property as mentioned above can have a peak in the loss tangent curve. The peak is preferably observed at a temperature of from 80° C. to 160° C., and the peak preferably has a height of not less than 3. When a peak is observed at a temperature lower than 80° C., the storage modulus (G') tends to decrease when the toner is preserved at a relatively high temperature, resulting in deterioration of the high temperature preservability of the toner (i.e., the toner aggregates when being preserved at a high temperature). When a peak is observed at a temperature higher than 160° C., the low temperature fixability of the toner tends to deteriorate.

In addition, when the height of the peak of the loss tangent (tan δ) curve of the toner is less than 3, the decreasing rate of the storage modulus (G') thereof is relatively low compared to the decreasing rate of the loss modulus (G") thereof, and therefore a good combination of low temperature fixability and hot offset resistance cannot be imparted to the toner.

The loss tangent (tan δ) of s toner (and a resin) is measured with a viscoelasticity measuring method. For example, the following method can be used.

(1) 0.8 grams of a sample (toner or resin) is pelletized using a die having a diameter of 20 mm upon application of pressure of 30 MPa; and (2) the loss modulus (G"), the storage modulus (G') and the loss tangent (tan δ) of the sample are measured using an instrument, ADVANCED RHEOMETRIC EXPANSION SYSTEM from TA with a parallel cone having a diameter of 20 mm.

The measuring conditions are as follows.

Frequency: 1.0 Hz

Temperature rising speed: 2.0° C./min

Strain: 0.1% (automatic strain control, allowable minimum stress: 1.0 g/cm, allowable maximum stress: 500 g/cm, maximum applied strain: 200%, strain adjustment: 200%)

In this regard, the data of the loss tangent obtained when the storage modulus (G') becomes not greater than 10 are excluded.

Thermoplastic resins are preferably used for the transparent toner. Among thermoplastic resins, resins having a (Mw/Mn) ratio (polydispersity) of the weight average molecular weight (Mw) thereof to the number average molecular weight (Mn) of not greater than 6 are preferably used. Particularly, it is not preferable to use resins, which are prepared by using a large amount of crosslinkable monomer and which have a broad molecular weight distribution because of having a number of branched chains, for the transparent toner because glossy images cannot be produced.

In order to produce glossy images, linear polyester resins or slightly crosslinked polyester resins are preferably used for the transparent toner. The (Mw/Mn) ratio of such polyester resins is preferably not greater than 6, and more preferably not greater than 5. When the (Mw/Mn) ratio is greater than 6, images produced by the toner tend to have low glossiness. It is possible to use two or more kinds of linear polyester resins and/or slightly crosslinked polyester resins for the transparent toner.

In the present application, the number average molecular weight (Mn) and the weight average molecular weight (Mw) of resins for use in the transparent toner are measured with a combination of an instrument using gel permeation chromatography (GPC), GPC-150C (Waters Corp.) and columns KF801-807 from Showa Denko K.K. The measuring method is as follows.

(1) The columns are stabilized at 40° C. in a heat chamber;

(2) Tetrahydrofuran is fed to the columns at a flow rate of 1 ml/min;

(3) 0.05 g of a sample (resin) is dissolved in 5 g of tetrahydrofuran and the solution is filtered using a filter (such as filters having pore size of 0.45 μm (e.g., CHOROMATODISK from Kurabo Industries Ltd.), and then diluted to prepare a THF solution of the resin having a concentration of from 0.05 to 0.6% by weight;

(4) 50 to 200 μl of the solution is fed to the columns to measure the weight average molecular weight (Mw) and the number average molecular weight (Mn) of the resin using a working curve showing relation between counts and amounts and prepared by using monodisperse polystyrenes.

The monodisperse polystyrenes are available from Pressure Chemical Co., or Tosoh Corp., and at least ten monodisperse polystyrenes having different molecular weights (such as $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$) are preferably used for preparing a working curve. In measurements, it is preferable to use a RI (refractive index) detector as the detector.

In the image forming method of the present invention, it is possible to perform only one fixing operation, but two or more fixing operations may be performed to produce highly glossy images. For example, an image forming method in which initially an image forming operation (charging process, irradiating process, developing process, transferring process and fixing process) is performed using one or more color toners and the transparent toner to prepare a glossier image portion (first image portion) on a recording material, and then a second image portion (i.e., normally glossy image portion) is formed on the recording material by performing a second image forming operation (charging process, irradiating process, developing process, transferring process and fixing process) using one or more color toners. In this method, the glossier image portion is subjected to the fixing process twice. Therefore, the first image portion has a higher glossiness than the second image portion.

When the fixing process is performed twice, a sufficient amount of heat can be applied to the first image portion which bears a relatively large amount of toner particles consisting of a chromatic toner image and a transparent toner image compared to the second image portion, thereby smoothing the surface of the first image portion, resulting in impartment of higher glossiness to the first image portion. In addition, since the second image portion is not fixed at a low fixing temperature (i.e., the second image portion is also fixed at the same temperature), a sufficient amount of heat is applied to the image, and thereby the second image portion can be firmly fixed to a recording material.

Since a transparent toner image is formed on a color toner image, the transparent toner image is directly contacted with a fixing member, and therefore the transparent toner preferably has better releasability, hot offset resistance and glossing property than color toners.

The glossing ability of a color toner is determined depending on the applications of the produced color image. When the color toner image formed by a color toner is required to have a high glossiness, it is preferable to use a resin having a small Mw/Mn ratio for the color toner. By contrast, when the color toner image is required to have a low glossiness, it is preferable to use a resin having a large Mw/Mn ratio for the color toner.

However, in a case where the color toner image (normally glossy image portion) has a relatively high glossiness, the transparent toner image formed on the color toner image also has high glossiness, but the difference in glossiness between the first image portion and the second image portion decreases. By contrast, in a case where the color toner image has a relatively low glossiness, the difference in glossiness between the first image portion and the second image portion can be increased, but the glossiness of the first image portion (glossier portion) is relatively low compared to that in the above-mentioned first case.

In the above-mentioned second case, the reason why the glossiness of the image is relatively low is considered to be that light scattering is caused at the interface between the transparent toner image and the color toner image due to the viscoelastic restoring force of the resin constituting the chromatic toner. Therefore, in order to produce a highly glossy image portion in the second case, it is preferable to increase the thickness of the transparent toner image formed on the color toner image. The thickness of the fixed transparent toner image is preferably from 1 μm to 15 μm. When the fixed transparent toner image has a thickness of less than 1 μm, it is hard to impart a high glossiness to a color image. By contrast, when the transparent toner image has a thickness of greater than 15 μm, the transparent toner image is insufficiently fixed (i.e., the fixed transparent toner has an insufficient mechanical strength), and in addition the transparent toner image has low transparency, resulting in deterioration of the color reproducibility of the color image. The thickness of a fixed toner image formed on a recording material can be determined by cutting a portion of the recording material bearing the toner image with a microtome, and visually observing the cross section of the toner image using a microscope.

A crystalline polyester resin can be used for the transparent toner as long as the transparent toner has the above-mentioned viscoelastic property.

When a crystalline polyester resin is used in combination with a noncrystalline polyester resin, the resultant toner has a good low temperature fixability, and a high glossiness can be imparted to an image even when the image is fixed at a relatively low fixing temperature. The added amount of a crystalline polyester resin is generally from 1 to 25 parts by weight, and preferably from 1 to 15 parts by weight, per 100 parts by weight of a noncrystalline polyester resin. When the added amount of a crystalline polyester resin is too high, a film of the crystalline polyester resin tends to be formed on the surface of an image bearing member such as a photoreceptor, resulting in deterioration of image qualities, and in addition the high temperature preservability of the toner tends to deteriorate. Further, the transparency of the transparent toner image tends to deteriorate. When a fatty acid amide based lubricant is included in the transparent toner together with a crystalline polyester resin, the lubricant imparts good lubricating property to the toner while accelerating crystallization of the polyester resin, thereby improving the high temperature preservability of the toner.

The transparent toner includes a lubricant. Since a transparent toner image takes the outermost position of overlaid plural toner images, the transparent toner image preferably has a good hot offset resistance, and therefore it is preferable to include a lubricant in the transparent toner so that the transparent toner image has good releasability from a fixing member. Specific examples of the lubricant include aliphatic hydrocarbon-based lubricants such as liquid paraffins, microcrystalline waxes, natural paraffins, synthesized paraffins, and polyolefin waxes, and partially-oxidized versions, fluorides and chlorides of these materials; animal-derived lubricants such as beef tallow and fish oils; plant-derived lubricants such as palm oil, soybean oil, canola oil, rice bran wax and carnauba wax; higher aliphatic alcohol/higher fatty acid based lubricants such as montan waxes; metal soap lubricants such as fatty amides, fatty bisamides, zinc stearate, calcium stearate, magnesium stearate, aluminum stearate, inc oleate, zinc palmitate, magnesium palmitate, zinc myristate, zinc laurate and zinc behenate; fatty acid esters, polyvinylidene fluoride, and the like, butarenot limited thereto. These materials can be used alone or in combination.

When such a lubricant is included inside transparent toner particles, the added amount thereof is from 0.1 to 15 parts by weight, and preferably from 1 to 7 parts by weight, per 100 parts by weight of the resin used for the transparent toner. When a lubricant is included inside transparent toner particles, good hot offset resistance can be imparted to the transparent toner while imparting a good combination of mechanical strength and abrasion resistance to fixed toner images. Therefore, even when the transparent toner is used for high speed image forming apparatuses, a transparent toner image can be fixed at a relatively low fixing temperature. When the added amount of a lubricant is smaller than 0.1 parts by weight, the hot offset resistance cannot be satisfactorily enhanced. By contrast, when the added amount is large than 10 parts by weight, the spent toner problem tends to be caused, resulting in deterioration of image qualities. When a lubricant is present on a surface of toner particles (for example, when toner particles are prepared y pulverizing a kneaded toner component mixture including a lubricant, the lubricant tends to be present on the surface of the resultant toner particles, the weight ratio (L/R) of the lubricant (L) to the resin (R) used for the transparent toner is from 0.001/100 to 1/100, and preferably from 0.01/100 to 0.3/100. It is preferable that when a lubricant is present on a surface of toner particles because the lubricant is directly contacted with the surface of an image bearing member, thereby forming a thin layer of the lubricant thereon, and therefore a toner image can be easily released from the surface of the image bearing member. In addition, adhesion of a toner image to the image bearing member can also be prevented.

Each of the transparent toner and color toners can include a charge controlling agent. Specific examples thereof include Nigrosine dyes and fatty acid metal salts, and their derivatives; onium salts such as phosphonium salts, and their lake pigments; triphenyl methane dyes and their lake pigments; higher fatty acids and metal salts thereof; diorganotin oxides such as dibutyltin oxide, dioctyltin oxide, and dicyclohexyltin oxide; diorganotin borates such as dibutyltin borate, dioctyltin borate, and dicyclohexyltin borate; organic metal complexes, chelate compounds, monoazo metal complexes, acetylacetone metal complexes, metal complexes of aromatic dicarboxylic acids, quaternary ammonium salts, aromatic hydroxyl carboxylic acids and their metal salts, aromatic mono- or poly-caboxylic acids and their metal salts, anhydrides and esters, phenol derivatives such as bisphenol, and the like. These materials can be used alone or in combination.

When a charge controlling agent is included inside the toners, the added amount of the charge controlling agent is from 0.1 to 10 parts by weight per 100 parts by weight of the binder resin included in the toners. In this regard, colorless or white charge controlling agents are preferably used for the transparent toner.

The transparent toner and color toners can include an external additive. Specific examples of such an external additive include abrasives such as silica, powders of TEFLON (registered trademark), powders of polyvinylidene fluoride, powders of cerium oxide, powders of silicone carbide, and powders of strontium titanate; fluidity imparting agents such as powders of titanium oxide, and powders of aluminum oxide; aggregation inhibitors; resin powders; electroconductive agents such as powders of zinc oxide, antimony oxide, and tin oxide; and developability improving agents such as white particulate materials and black particulate materials having charges with opposite polarities. These external additives can be used alone or in combination. By using such an external additive for a toner, the toner has good resistance to stresses caused in a developing device.

When a two-component developing method is used, a developer including a magnetic carrier and a toner such as a transparent toner and a color toner is used. Specific examples of the carrier include spinel-form ferrites such as magnetite and γ-iron oxide, spinel-form ferrites including one or more metal other than iron such as Mn, Ni, Mg and Cu, magnetoplumbite-form ferrites such as barium ferrite, and particulate metals (Fe or metal alloys) having an oxide layer on the surface thereof. The shape of the particulate carrier is not particularly limited, and for example, granular, spherical and needle-form carriers can be used. When a carrier having a relatively high magnetization intensity is needed, ferromagnetic particulate materials (such as iron) are preferably used. In view of chemical stability, spinel-form ferrites (such as magnetite and γ-iron oxide), and magnetoplumbite-form ferrites (such as barium ferrite) are preferably used.

Specific examples of the marketed carrier materials include MFL-35S, and MFL-35HL, which are from Powdertech Co., Ltd., DFC-400M, DFC-410M, and SM-350NV, which are from Dowa IP Creation Co., Ltd., and the like.

By using a proper ferromagnetic particulate material for a resin carrier while controlling the added amount thereof, a resin carrier having a desired magnetization intensity of from 30 to 150 emu/g (30 to 150 $A \cdot m^2/kg$) at 1000 Oe ($7.96 \times 10^4$ A/m) can be provided. Such resin carriers can be prepared, for example, by a method in which a particulate magnetic material and an insulating resin are heated so that the resin is melted, the mixture is then kneaded, and the kneaded mixture is sprayed using a spray drier, or a method in which a monomer or a prepolymer dispersed in an aqueous medium in the presence of a particulate magnetic material is reacted and crosslinked to form a condensation polymer (binder resin) in which the particulate magnetic material is dispersed.

It is possible to control the charging ability of a magnetic carrier by adhering a positively or negatively chargeable particulate material or electroconductive material on the surface of the magnetic carrier or by coating the surface of the magnetic carrier with a resin. Specific examples of the resin material used for the coating liquid include silicone resins, acrylic resins, epoxy resins, fluorine-containing resins, and the like. The coating liquid can include a positively or negatively chargeable particulate material or electroconductive material. Among these resin materials, silicone resins and acrylic resins can be preferably used.

The content of the toner in the developer contained in the developing device of the image forming apparatus of the present invention is preferably from 2% to 10% by weight (i.e., the weight ratio (T/C) of the toner (T) to the carrier (C) is from 2/98 to 10/90).

In the present invention, the particle size of toner is determined from a number basis particle diameter distribution and a volume basis particle diameter distribution of the toner obtained by using an instrument, COULTER MULTISIZER III from Beckman Coulter Inc. The procedure is as follows:

(1) a sample (toner) is mixed with an electrolyte to which a surfactant is added;

(2) the mixture is dispersed for 1 minute using an ultrasonic dispersing machine; and (3) the number basis particle diameter distribution and the volume basis particle diameter distribution of 50,000 particles of the sample (toner) are measured, followed by averaging.

The average particle diameter is preferably from 2 μm to 10 μm.

The method for preparing the transparent toner and the color toners is not particularly limited. For example, the following method can be used.

(1) toner components such as a binder resin (fixable resin), a lubricant, an optional colorant, and an optional fixable resin, in which a charge controlling agent and an additive are dispersed, are mixed using a mixer such as HENSCHEL MIXER and SUPER MIXER;

(2) the mixture is heated so as to be melted and kneaded with a kneader such as heat rolls, kneaders and extruders so that the toner components are satisfactorily mixed; and (3) after the kneaded mixture is cooled, the mixture is crushed and pulverized, followed by classification to prepare a toner.

In the pulverization process, a jet mill in which a crushed kneaded mixture is fed into high speed airflow so as to be collided against a collision plate to be pulverized, an interparticle collision method in which a crushed kneaded mixture is collided against each other to be pulverized, a mechanical pulverization method in which a crushed kneaded mixture is fed into a gap between a rotor rotated at a high speed and a stator to be pulverized, and the like, can be used.

In addition, the following solution suspension method can also be used for preparing the toners.

(1) toner components (such as the above-mentioned components) and an optional reactive resin are dissolved or dispersed in an organic solvent to prepare an oil phase liquid;

(2) the oil phase liquid is dispersed in an aqueous phase liquid;

(3) after optionally reacting the reactive resin (such as polymer chain growth reaction of a polyester prepolymer), the organic solvent is removed from the dispersed oil phase liquid to prepare a dispersion of toner particles; and (4) after filtering the toner particle dispersion, the toner particles are washed, and then dried, resulting in formation of a mother toner (dry toner particles).

Next, the image forming apparatus of the present invention will be described.

Figure 4:
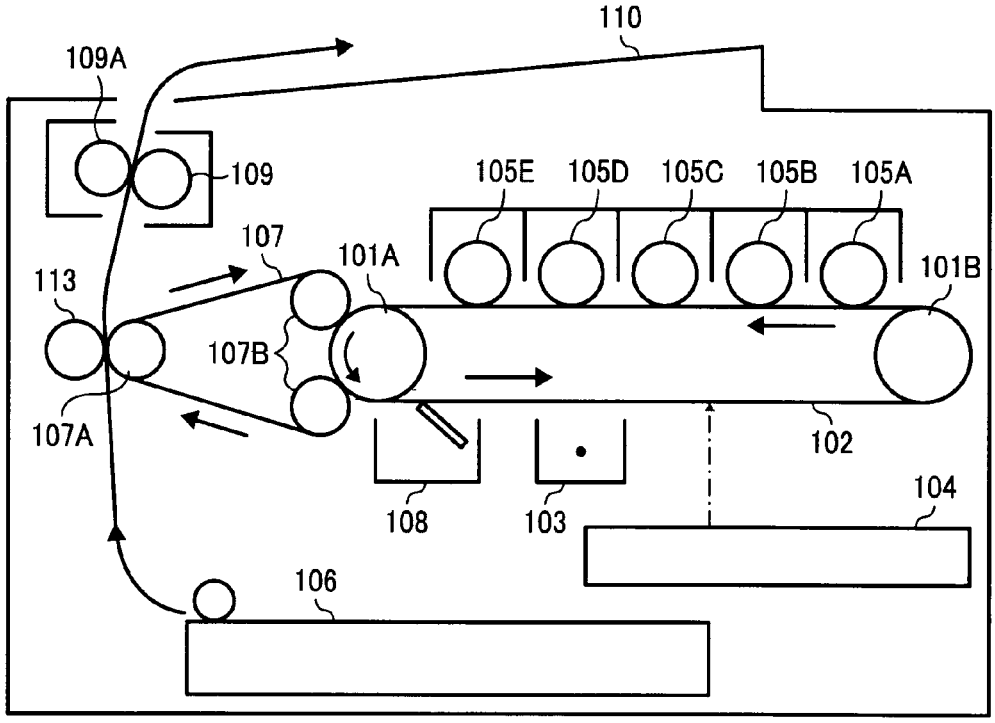
FIG. 4 is a schematic cross-sectional view illustrating an example of an image forming apparatus of the present invention.

FIG. 4 illustrates an electrophotographic image forming apparatus, which is an example of an image forming apparatus of the present invention.

Referring to FIG. 4, the image forming apparatus includes a photoreceptor belt 102, which is rotated by a driving roller 101A and a driven roller 101B while tightly stretched thereby. In addition, the image forming apparatus includes a charger 103 to charge the surface of the photoreceptor belt 102, an image writing unit 104 to irradiate the charged photoreceptor belt 102 with a laser beam to form an electrostatic latent image on the photoreceptor belt 102, developing units 105A-105D which contain yellow, magenta, cyan and black toners to develop electrostatic latent images with the toners to prepare color toner images on the surface of the photoreceptor belt 102, and a developing unit 105E which contains a transparent toner to form a transparent toner image on the photoreceptor belt 102. The image forming apparatus further includes a recording material sheet cassette 106 to contain and feed sheets of a receiving material such as paper sheets, an intermediate transfer belt 107, to which the toner images formed on the photoreceptor belt 102 are transferred by a secondary transfer roller 113 and which are rotated by a driving roller 107A, and driven rollers 107B and 107B, a cleaner 108 to clean the surface of the photoreceptor belt 102 after the toner images thereon are transferred, a fixing device including a fixing roller 109 and a pressure roller 109A to fix the toner image on the receiving material, and a copy tray 110 on which a copy (a receiving material sheet bearing a fixed toner image thereon) is discharged.

This color image forming apparatus uses the intermediate transfer belt 107, which is a flexible belt and which is rotated clockwise by the driving roller 107A and a pair of driven rollers 107B while tightly stretched thereby. A portion of the intermediate transfer belt 107 located between the pair of driven rollers 107B and 107B is contacted with the outer surface of a portion of the photoreceptor belt 102 contacted with the driving roller 101A.

When a full color image is formed in the color image forming apparatus, yellow, magenta, cyan and black toner images formed on the photoreceptor belt 102 are sequentially transferred onto the intermediate transfer belt 107 so as to be overlaid, thereby forming a combined color toner image on the intermediate transfer belt 107. The combined color toner image is transferred onto a recording material sheet, which is fed from the recording material sheet cassette 106, by the secondary transfer roller 113. The recording material sheet bearing the combined color toner image thereon is fed to a fixing nip between the fixing roller 109 and the pressure roller 109A so that the toner image is fixed thereon by the rollers 109 and 109A. The recording material sheet bearing the fixed toner image thereon (i.e., copy) is discharged on the copy tray 110.

After the developing devices 105A-105E perform the developing operations using the respective developers contained therein, the concentrations of toners contained in the developers decrease. When decrease of the toner concentration is detected by a toner concentration sensor (not shown), developer supplying devices connected with the respective developing devices 105A-105E are operated and developers including the respective toners are supplied to the developing devices 105A-105E to increase the toner concentrations.

The method for supplying the developers is not particularly limited, and for example a method including supplying a developer using a screw, a method including supplying a developer using air, and the like can be used.

In the image forming apparatus illustrated in FIG. 4, color toner images formed on the photoreceptor 102 are overlaid on the intermediate transfer belt 107. However, the image forming apparatus of the present invention is not limited thereto.

For example, a direct-transfer type image forming apparatus in which color toner images formed on one or more photoreceptors are directly transferred onto a recording material can also be used as the image forming apparatus of the present invention.

Figure 5:
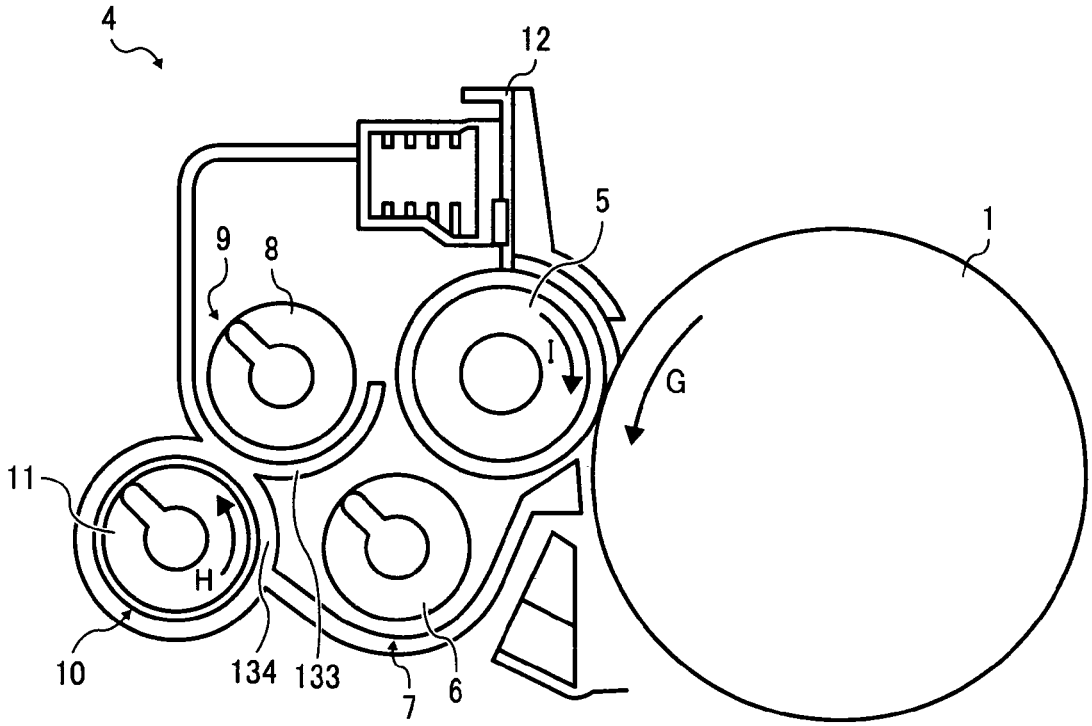
FIG. 5 is a schematic cross-sectional view illustrating an image bearing member and a developing device of another example of an image forming apparatus of the present invention.
Figure 6:
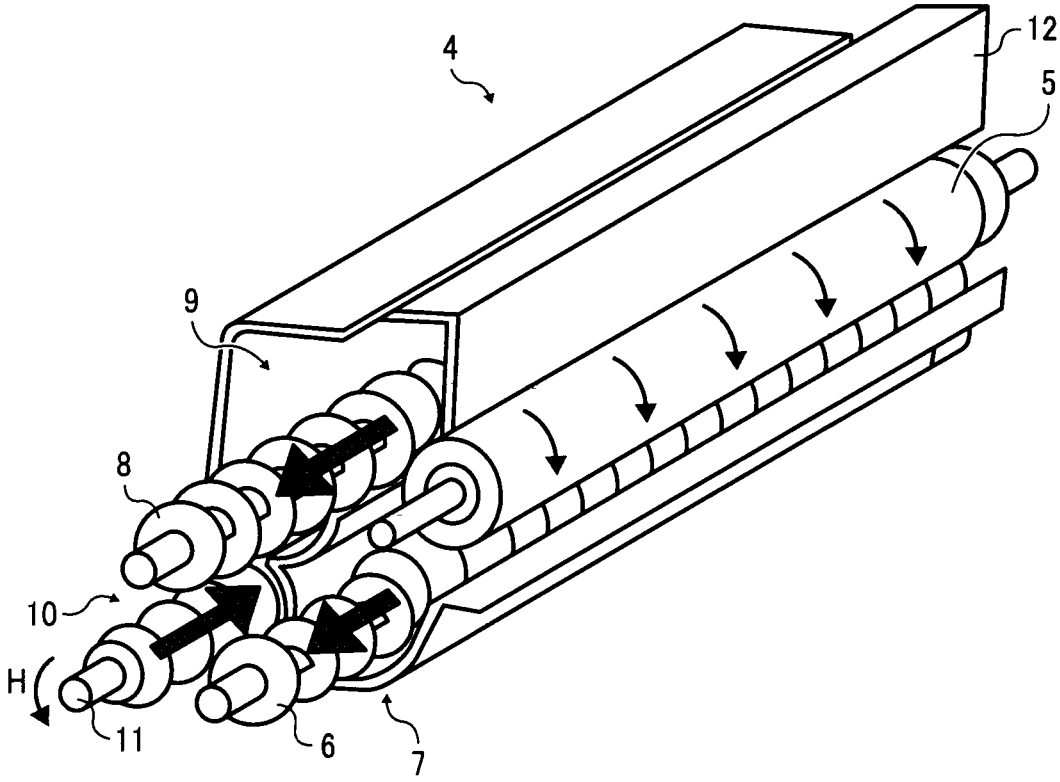
FIG. 6 is a schematic perspective view for explaining how the developer flows in the developing device illustrated in FIG. 5.
Figure 7:
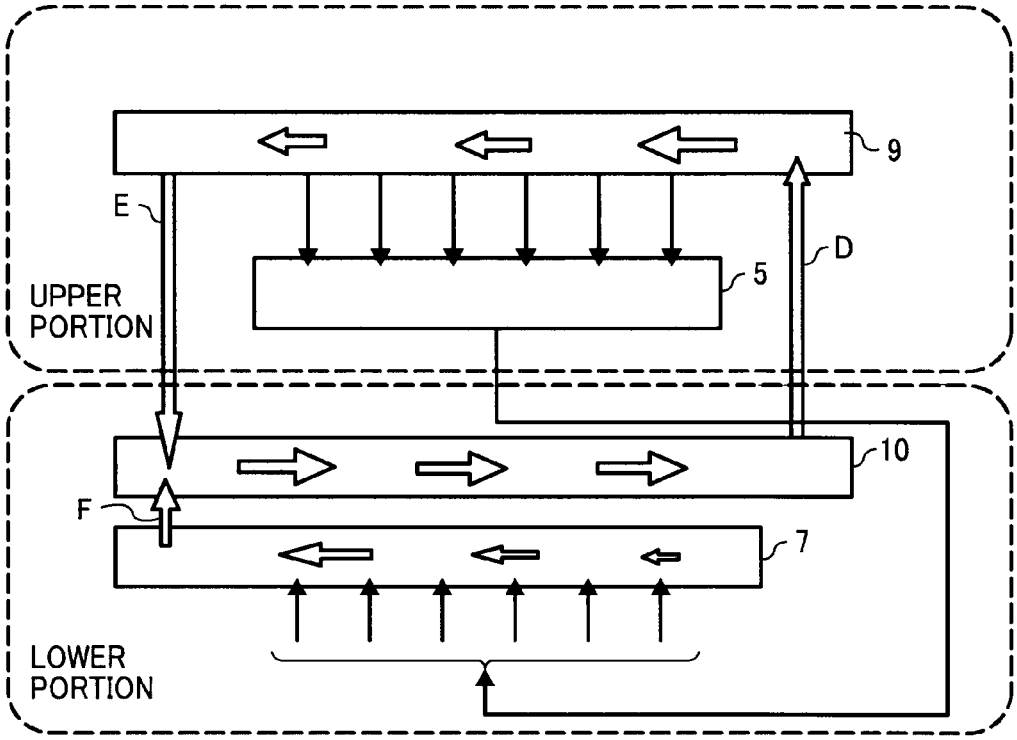
FIG. 7 is a schematic view for explaining how the developer flows in the developing device illustrated in FIG. 5.

Next, the configuration of the developing device and peripheral devices of the image forming apparatus will be described. FIGS. 5-7 illustrate developing devices for use in an image forming apparatus of the present invention, which include a developer supplying passage, a developer collecting passage and a developer agitating passage, which are separated from each other by partitions.

As illustrated in FIG. 5, the photoreceptor 1 is rotated in a direction indicated by an arrow G. The surface of the photoreceptor 1 is charged with a charger (not shown). The charged surface of the photoreceptor 1 is exposed to a laser beam emitted from an optical image writing unit, resulting in formation of an electrostatic latent image on the photoreceptor 1. The electrostatic latent image is developed with the toner in the developer supplied from the developing device 4, resulting in formation of a toner image on the photoreceptor 1.

The developing device 4 includes the developing roller 5, which serves as a developer bearing member and which is rotated in a direction indicated by an arrow I to supply the developer to the electrostatic latent image on the photoreceptor 1, and the supplying screw 8, which serves as a developer supplying member and which supplies the developer to the developing roller 5 while feeding the developer toward the inner side thereof (i.e., in a direction of from the front side of the paper sheet, on which FIG. 5 is printed, to the backside of the paper sheet). The supplying screw 8 includes a rotation shaft and a blade provided on the rotation shaft, and serves as a developer feeding screw, which feeds the developer in the axis direction thereof by rotating.

A doctor blade 12 is provided on a downstream side from the opposed position, at which the developing roller 5 and the supplying screw 8 are opposed, relative to the rotation direction I of the developing roller. The doctor blade 12 serves as a developer layer thickness controlling member configured to control the thickness of the developer layer on the developing roller 5.

The developing device 4 further includes the collection screw 6, which is provided on a downstream side from the development region, at which the developing roller 5 and the photoreceptor 1 are opposed, relative to the rotation direction I of the developing roller. The collection screw 6 collects the developer used for development and feeds the collected developer toward the inner side of the collection screw 6 (i.e., in the same direction as that of the feeding direction of the supplying screw 8). As illustrated in FIG. 5, the developer supplying passage 9 is provided beside the supplying screw 8, and the developer collecting passage 7 is provided below the developing roller 5.

The developing device 4 further includes the developer agitating passage 10, which is located below the developer supplying passage 9 and which is parallel to the developer collecting passage 7. The developer agitating passage 10 includes the agitation screw 11 rotated in a direction H to feed the developer in the direction opposite to the developer feeding direction of the supplying screw 8 while agitating the developer.

The developer agitating passage 10 is separated from the developer supplying passage 9 with a portion of a first partition wall 133. An opening is formed on both ends of the first partition wall 133 in the developer feeding direction of the supplying screw 8, and therefore the developer supplying passage 9 and the developer agitating passage 10 are communicated with each other through the openings.

The developer supplying passage 9 is separated from developer collecting passage 7 with another portion of the first partition wall 133, which portion includes no opening.

The developer agitating passage 10 is separated from the developer collecting passage 7 with a second partition wall 134. The second partition wall 134 has one opening on the front side thereof, and thereby the developer agitating passage 10 is communicated with the developer collecting passage 7 through the opening.

Each of the developer supplying screw 8, collection screw 6 and agitation screw 11 is a resin screw, which has, for example, a diameter of 18 mm and a screw pitch of 25 mm and which is rotated at a revolution of about 600 rpm.

The developer layer formed on the developing roller 5 by the doctor blade 12 is fed to the development region at which the developing roller 5 is opposed to the photoreceptor 1 to develop an electrostatic latent image on the photoreceptor 1. The surface of the developing roller 5 has V-shaped grooves or is subjected to a sand-blasting treatment. For example, an aluminum cylinder having a diameter of 25 mm is used as the development roller 5. The gap between the photoreceptor 1 and the doctor blade 12 is about 0.3 mm.

The developer used for developing electrostatic latent images is collected in the developer collecting passage 7 and the collected developer is fed to the front side of the developer collecting passage. The thus fed developer is then fed to the agitating passage 10 through the opening of the second partition wall 134, which is located on a portion corresponding to a non-image-forming area of the photoreceptor 1 and which is located on the downstream side relative to the developer feeding direction of the developer collecting passage 7. A toner supplying opening is provided on an upper portion of the developer agitating passage 10, which is located on an upstream side relative to the developer feeding direction of the developer agitating passage 10 and which faces one of the openings of the first partition wall 133, and a supplementary toner is supplied to the developer agitating passage 10 from the toner supplying opening.

Next, flow of the developer in the three developer passages 9, 7 and 10 will be explained by reference to FIGS. 6 and 7.

FIG. 6 is a perspective view for explaining flow of the developer in the developing device 4 illustrated in FIG. 5. In FIG. 6, arrows indicate the moving directions of the developer. In addition, FIG. 7 is a schematic view illustrating flow of the developer in the developing device 4 illustrated in FIG. 5. In FIG. 7, arrows indicate the moving directions of the developer.

Referring to FIGS. 6 and 7, the developer is supplied from the developer agitating passage 10 to the developer supplying passage 9 as indicated by an arrow D. The developer supplying passage 9 supplies the developer to the developing roller 5 while feeding the developer in the developer feeding direction of the supplying screw 8 as indicated by three outline arrows in FIG. 7. The developer (i.e., excessive developer), which is supplied to the developing roller 5 but is not used for developing until the developer is fed to the downstream side of the supplying passage 9, is returned to the developer agitating passage 10 through another opening of the first partition 133 as indicated by an arrow E in FIG. 7.

On the other hand, the developer passing through the development region and fed to the developer collecting passage 7 from the developing roller 5 is fed by the collection screw 6. The developer (collected developer) fed to the downstream side of the developer collecting passage 7 is fed to the developer agitating passage 10 through the opening of the second partition 134 as indicated by an arrow F in FIG. 7.

In the developer agitating passage 10, the excessive developer and the collected developer are agitated, and the mixed developer is fed to the downstream side of the developer agitating passage 10 (i.e., the upstream side of the developer supplying passage 9) with the agitation screw 11. The mixed developer is then fed to the developer supplying passage 9 through the opening of the first partition 133 as indicated by the arrow D in FIG. 7.

In addition, a supplementary toner is added to the developer agitating passage 10, if necessary. The supplementary toner is mixed with the collected developer, and the excessive developer, and the mixed developer is fed to the downstream side of the developer agitating passage 10 (i.e., the upstream side of the developer supplying passage 9) by the agitation screw 11 as mentioned above. A toner concentration sensor (not shown) is provided on a lower portion of the developer agitating passage 10. Depending on the output of the toner concentration sensor, a developer supply controller allows a developer supplying device (illustrated in FIG. 11) of the developing device 4 to perform a developer supplying operation in which the supplementary toner is supplied from a container to the developing device 4.

The developing device 4 illustrated in FIG. 7 includes the developer supplying passage 9 and the developer collecting passage 7 so that the developer supplying operation and the developer collecting operation are performed in the different passages. Therefore, it is impossible that the developer, which has been used for development, is mixed with the developer in the developer supplying passage 9. Therefore, occurrence of a problem in that the developer located on the downstream side of the developer supplying passage 9 has a lower toner concentration than the developer in the other portions of the developer supplying passage 9 can be prevented.

In addition, the developing device 4 includes the developer collecting passage 7 and the developer agitating passage 10 so that the developer collecting operation and the developer agitating operation are performed in the different passages. Therefore, the developer, which has been used for development, never falls into the developer in process of agitating. Thus, the well agitated developer is supplied to the developer supplying passage 9. Therefore, the developer in the developer supplying passage 9 has a constant toner concentration in the developer feeding direction, thereby forming toner images having a constant image density on the photoreceptor 1.

Figure 8:
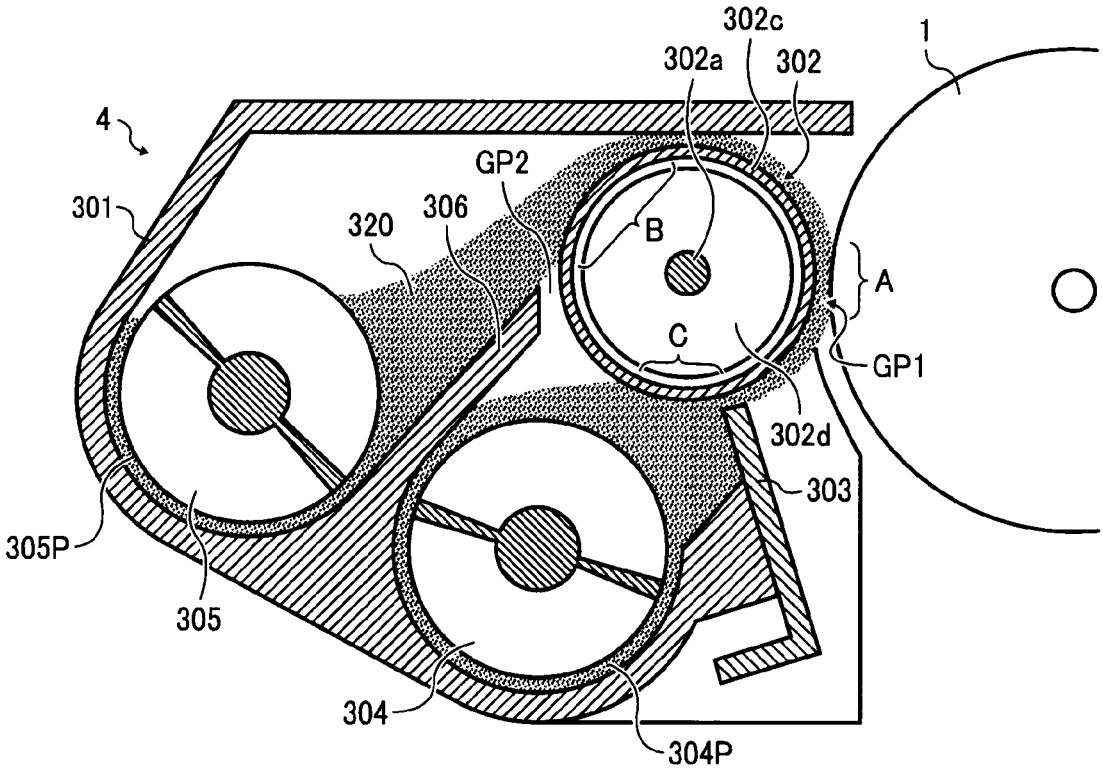
FIG. 8 is a schematic cross-sectional view illustrating another developing device for use in an image forming apparatus of the present invention.

FIG. 8 illustrates another developing device (two-passage one-way circulation developing device) for use in an image forming apparatus of the present invention.

Referring to FIG. 8, the developing device 4 includes a casing 301, and a developer supplying member 304 for agitating and feeding a developer 320 in a developer supplying passage 304P, a developer agitating member 305 for agitating and feeding the developer 320 in a developer agitating passage 305P, and a developing roller 302, which are arranged in the casing 301. The developing roller 302 has almost the same length (in the axis direction) as the photoreceptor 1.

The developing roller 302 is arranged so as to face the photoreceptor 1 to form a development region A. The casing 301 has opening so that the developing roller 302 can form the development region A with the photoreceptor 1.

The developer 320 in the casing 301 is fed to the development region A by the developing roller 302. The toner included in the developer 320 is adhered to an electrostatic latent image formed on the photoreceptor 1 at the development region A, resulting in formation of a visible image (i.e., a toner image) on the photoreceptor.

As mentioned above, the developing roller 302, developer supplying member 304, and developer agitating member 305 are arranged in the casing 301 of the developing device 4 to circulate the developer 320 while agitating the developer.

The developing roller 305 includes a fixed shaft 302*a*, a sleeve 302*c* having a cylindrical form, which is made of a nonmagnetic metal such as aluminum, and a magnet roller 302*d*, which is provided in the sleeve and has plural magnets provided in the peripheral direction of the developing roller 302. The sleeve 302*c* rotates around the magnet roller to feed the developer 320, which is attracted by the magnet roller 302*d*.

The developing roller 302 and the photoreceptor 1 are not directly contacted with each other at the development region A, and a predetermined gap GP1 is formed between the surfaces thereof.

Since the developer on the developing roller 302 is erected due to a magnetic field formed by the magnets in the developing roller to form a magnetic brush of the developer, the magnetic brush (which includes the toner and the carrier) is contacted with the surface of the photoreceptor 1, resulting in formation of a visible toner image on the photoreceptor 1.

In this developing device 4, a power source (which is not shown and which has an end connected with ground) applies a bias to the shaft 302*a* of the developing roller 302 to apply a voltage to the sleeve 302*c*. On the other hand, the electroconductive substrate serving as an undermost layer (not shown) of the photoreceptor 1 is grounded.

Thus, an electric field is formed in the development region A, and thereby the toner in the developer is moved toward the photoreceptor 1 due to the potential difference between the sleeve 302*c* and an electrostatic latent image formed on the photoreceptor 1.

The developing device 4 uses a reverse development method. Specifically, an electrostatic latent image is formed on the photoreceptor 1 by charging (for example, negatively) the photoreceptor with a charger (not shown) and then irradiating the charged photoreceptor with the optical image writing unit so that the irradiated portions correspond to the image portions have a lower potential, to reduce the total light irradiating time. The thus formed electrostatic latent images are developed with a negatively charged toner using a reverse development method. The development method is not limited thereto, and any other development methods (including polarity of charge of the charging methods) can be used for the developing device 4.

After developing an electrostatic latent image, the developer 320 on the developing roller 302 is fed to the downstream side due to rotation of the developing roller, followed by entering into the casing 301. The casing 301 has a curved portion, which is provided so as to be close to the peripheral surface of the sleeve 302*c* to prevent the toner from being scattered. The developer 320 is then separated from the developing roller 302 in a developer separating region B illustrated in FIG. 8 by the magnetic force of the magnet roller in the developing roller 302.

In this regard, the developer 320 thus separated from the developing roller 302 has a relatively low toner concentration. Therefore, if the developer 320 is not separated from the developing roller 302 and is used again for developing electrostatic latent images in the development region A, images with a predetermined image density cannot be produced.

In order to prevent occurrence of such a problem, the developer 320 used for development is separated from the developing roller 302 in the developer separating region B. The developer 320 thus separated from the developing roller 302 is mixed with the developer 320 in the casing 301 and a fresh developer, and the mixture is agitated in the casing so that the developer 320 has the predetermined toner concentration and the toner is charged so as to have the predetermined charge quantity (hereinafter this developer is sometimes referred to as the revived developer).

The revived developer 320 is then drawn by the developing roller 302 in a developer drawing region C illustrated in FIG. 8. When the thus drawn developer 320 passes through the developer thickness controlling member 303, a developer layer having a predetermined thickness is formed on the developing roller 302 while forming a magnet brush. The thus formed developer layer is fed to the development region A.

Next, the configuration of the developing device 4 illustrated in FIG. 8 will be described by reference to FIGS. 9 and 10.

As illustrated in FIG. 8, the developer supplying member 304 is provided in the vicinity of the developing roller 302 and the developer drawing region C. In addition, the developer supplying member 304 is located on an upstream side from the developer layer thickness controlling member 303. As illustrated in FIGS. 9 and 10, the developer supplying member 304 has a screw form such that a spiral is formed around a rotation shaft, and is rotated around an axis O-304*a* which is parallel to an axis O-302*a* (i.e., a line passing a center O-302 of the developing roller 302). The developer supplying member 304 feeds the developer along the shaft thereof in a direction indicated by an arrow D11 in FIG. 9 (i.e., in a direction of from the inner side of the developer supplying member 304 to the front side thereof).

As illustrated in FIG. 8, the developer agitating member 305 is provided in the vicinity of the developer separating region B of the developing roller 302. As illustrated in FIG. 9, the developer agitating member 305 has a screw form such that a spiral is formed around a rotation shaft, and is rotated around an axis O-305*a* which is parallel to the axis O-302*a* (i.e., the line passing the center O-302 of the developing roller 302). The developer agitating member 305 feeds the developer along the shaft thereof in a direction indicated by an arrow D12 in FIG. 9 (i.e., in a direction of from the front side of the developer agitating member 305 to the inner side thereof). Namely, the developer agitating member 305 feeds the developer in the direction D12 opposite to the developer supplying direction D11.

It is preferable that the developer agitating member 305 is located obliquely above the developer supplying member 304 and the space surrounding the developer supplying member 304 is adjacent to the space surrounding the developer agitating member 305 in the casing 301. The inner edges of the developer supplying member 304 and the developer agitating member 305 are located on a relatively inner side from the inner edge of the developing roller 302 so that the developer can be supplied to the edge portion of the developing roller 302 similarly to the center portion thereof. Similarly, the front edges of the developer supplying member 304 and the developer agitating member 305 are located on a relatively front side from the front edge of the developing roller 302 so that the supplementary toner can be supplied to the front edges. The developer layer thickness controlling member 303 has almost the same length as the developing roller 302.

A partition 306 is provided to separate the space surrounding the developer supplying member 304 from the space surrounding the developer agitating member 305 except for both the edge portions of the developing roller 302 in the axis direction of the developing roller 302. The partition 306 is provided on a portion of the casing 301 while the tip of the partition is not supported as illustrated in FIG. 8.

As mentioned above, the partition 306 is located so as to face the developing roller 302 except for the edge portions thereof, and in contrast the edge portions of each of the developer supplying member 304 and the developer agitating member 305 extend so as to face the corresponding edge portions of the developing roller 302. Therefore, the developer, which is fed in the direction D12 by the developer agitating member 305 reaches the side wall of the casing 301, is moved toward the developer supplying passage 304P (i.e., in a direction D13 illustrated in FIG. 10) by the developer supplying member 304. The developer is then fed in the direction D11 through the developer supplying passage 304P by the developer supplying member 304.

Figure 9:
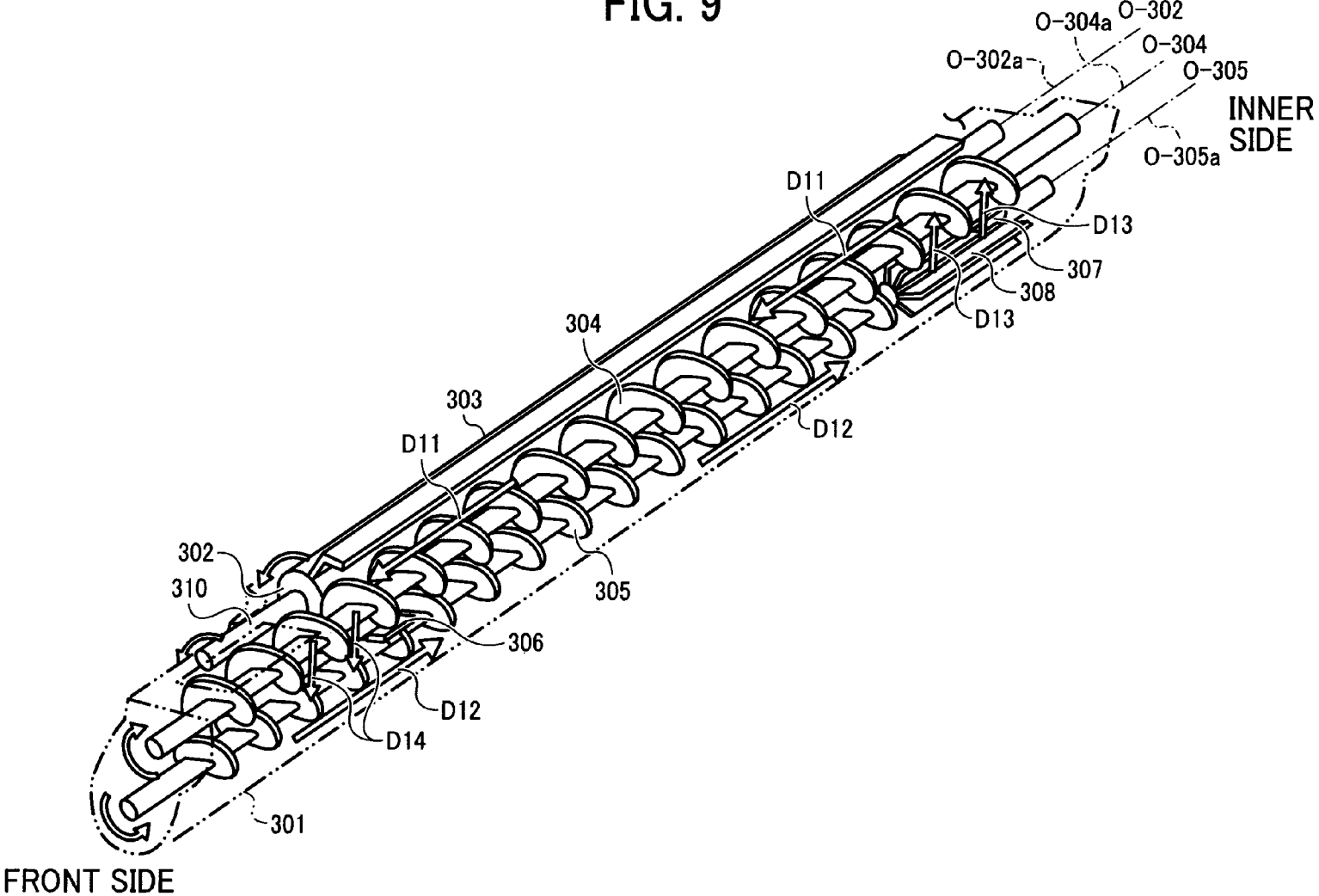
FIGS. 9 and 10 are schematic perspective and exploded views illustrating the developing device illustrated in FIG. 8.

Similarly, the developer, which is fed in the direction D11 by the developer supplying member 304 and reaches the side wall of the casing 301, is moved toward the developer agitating passage 305P (i.e., in a direction D14 illustrated in FIG. 9). The developer is then fed in the direction D12 through the developer agitating passage 305P by the developer agitating member 305.

The reason why the partition 306 is not provided for both edge portions of the developing roller 302 is that the developer can be flown in the directions D13 and D14, i.e., the developer can be circulated in the order of the directions D11, D14, D12 and D13.

Figure 10:
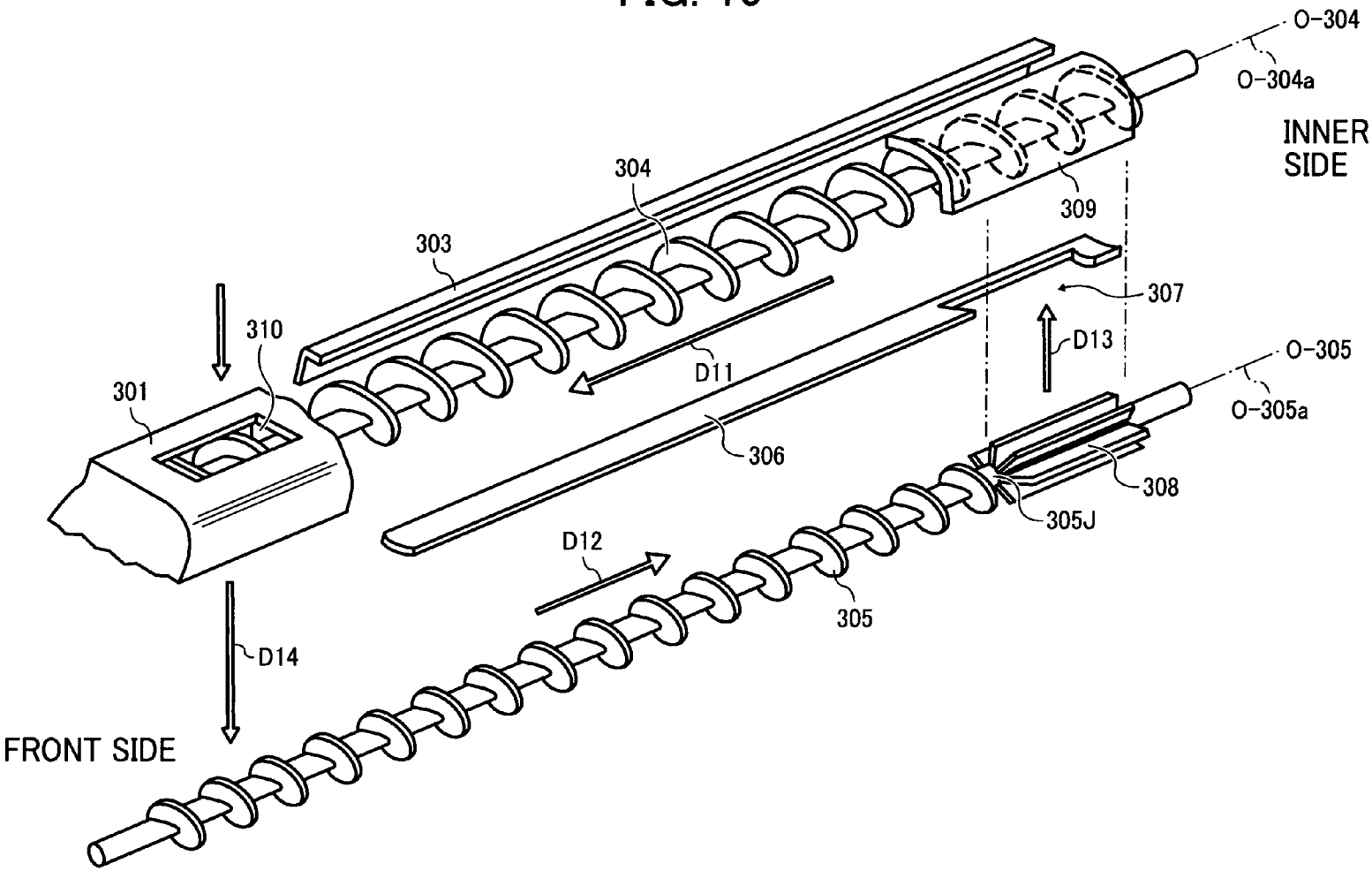

As illustrated in FIG. 10, the partition 306 has an opening 307 at an inner portion thereof so that the developer can be fed from the developer agitating passage 305P to the developer supplying passage 304P through the opening 307. In this case, the inner edge of the partition may extend so as to face the inner edge portion of the developing roller 302 because the partition 306 has the opening 307.

It is clear from comparison of FIG. 8 with FIG. 5 that the length of the developing device 4 illustrated in FIG. 8 in the horizontal direction perpendicular to the direction D11 or D12 is smaller than that of the developing device 4 illustrated in FIG. 5 because only the two feeding members (i.e., the developer supplying member 304 and the developer agitating member 305) are arranged in the vicinity of the developing roller 302. Therefore, the developing device 4 illustrated in FIG. 8 has a smaller size than the developing device 4 illustrated in FIG. 5.

Although the developing device 4 illustrated in FIG. 8 has a compact size, only the developer which includes the toner at a predetermined concentration and in which the toner and the carrier are mixed well is supplied to the developing roller 302 by the developer supplying member 304 because the partition 306 is provided. Namely, the developer used for development is not directly returned to the developing roller 302 and is fed and agitated by the developer agitating member 305. Therefore, the developer supplied to the developing roller 302 has a predetermined toner concentration and a predetermined charge quantity, thereby stably forming high quality images.

The partition 306 not only forms the developer supplying passage 304P by supporting the developer 320 agitated and fed by the developer supplying member 304, but also prevents the developer, which is used for development and which is separated from the developing roller 302 and is fed by the developer agitating member 305 through the developer agitating passage 305P, from being moved to the developer supplying passage 304P due to attraction (magnetic force) of the developing roller 302.

In order to securely exercise the function of the partition 306, a gap GP2 between the tip of the partition 306 and the circumferential surface of the developing roller 302 is preferably from 0.2 to 1 mm. When the gap GP2 is less than 0.2 mm, a problem in that the tip of the partition 306 strikes the surface of the developing roller 302 due to eccentricity of the developing roller can occur. In contrast, when the gap is greater than 1 mm, a problem in that the developer in the developer agitating passage 305P is moved to the developer supplying passage 304P due to attraction of the developing roller 302 can occur. By thus setting the partition 306, the function of the partition 306 can be fully exercised even when the position of the partition 306 relative to the developer separating region B is changed. Namely, the flexibility of installation location of the partition 306 can be enhanced.

Even when the partition 306 is farther apart from the developer separating region B, the function of the partition 306 can be exercised. However, in this case the partition 306 regulates a large amount of developer, and thereby a large stress is applied to the developer. Therefore, it is not preferable.

In this case, as illustrated in FIG. 8, it is preferable that the developer separating region B is located on an opposite side of the developing roller 302 from the development region A, the developer drawing region C is located on a downstream side from the developer separating region B while being adjacent to the region B, and the partition 306 is provided at a location between the developer separating region B and the developer drawing region C so that the amount of the developer born on the developing roller 302 is relatively small, wherein the tip of the partition faces the developing roller 302.

By setting the partition in such a manner, the function of the partition 306 can be fulfilled, even when the gap GP2 falls outside the above-mentioned range of from 0.2 mm to 1.0 mm, because the amount of the developer born on the developing roller 302 is relatively small at the position in which the partition 306 is arranged. In addition, since the developer is regulated by the partition 306 and thereby the stress applied to the developer can be minimized, resulting in enhancement of flexibility of gap controlling. Needless to say, it is more preferable that the gap GP2 is set to fall in the range of from 0.2 mm t0 1.0 mm, because the stress applied to the partition can be further reduced.

As illustrated in FIGS. 9 and 10, the developer agitating member 305 agitates and feeds the developer, which has been separated from the developing roller 302, toward the inner side of the developing device (i.e., in the direction D12). Since the opening 307 is provided on the inner side of the partition 306, the developer 320 fed by the developer agitating member 305 is fed to the developer supplying passage 304P (i.e., in the direction D13).

As illustrated in FIG. 10, the portion of the developer agitating member 305 facing the opening 307 may be a bladed wheel 308 instead of a screw. The bladed wheel 308 has plural blades, which are provided on a shaft 305J of the developer agitating member 305 and which radially extend from the center line O-305*a* of the developer agitating member 305. The blade wheel 308 has a function of scattering the developer 320.

Since the blade wheel 308 rotates, the blade wheel 308 scatters the developer along the inner wall of the casing 301. Therefore, the opening 307 preferably extends from a point, which is slightly closer to the inner wall of the casing 301 than the vertical line connecting the centers O-304 and O-305, to the inner wall of the casing 301 so that the scattered developer can be satisfactorily fed to the developer supplying passage 304P from the developer agitating passage 305P.

The rotation direction of the developer supplying member 304 is preferably opposite to that of the developing roller 302. The reason therefor is that such a screw feeds a material (i.e., developer) in the axis direction thereof while collecting the material in the rotating direction, and by rotating the developer supplying member 304 in the direction opposite to that of the developing roller 302, the developer supplying member 304 feeds the developer while collecting the developer so as to be close to the developing roller 302, thereby efficiently supplying the developer to the developing roller 302.

The rotation direction of the developer agitating member 305 is preferably the same as that of the developing roller 302. In this case, the developer agitating member 305 feeds the developer while collecting the developer in such a direction that the developer is separated from the developing roller 302. Therefore, occurrence of a problem in that the developer separated from the developing roller 302 by the magnetic force of the magnets in the developing roller or by the partition 306 is adhered again to the developing roller can be prevented. Therefore, the developer used for development and having a low toner concentration is prevented from being fed to the developer supplying member 304.

Since the toner in the developer 320 in the developing device 4 is consumed as the developing operations are repeated, it is necessary to supply the toner to the developer from outside. As illustrated in FIG. 10, it is preferable to supply a supplementary toner from an opening 310 located near the front end portion of the developer agitating member 305 and the developer separating region B. In this case, the added toner can be satisfactorily mixed with the developer by the developer agitating member 305 without directly used for development, resulting in revival of the developer. Thus, the revived developer, which includes the toner at the predetermined concentration and in which the toner is satisfactorily charged, is supplied to the developing roller 302.

The developer agitating passage 305P only collects the developer separated from the developing roller 302, namely the developer agitating passage 305P does not supply the developer to the developing roller 302. Therefore, a problem in that the developer, in which the supplied fresh toner is unevenly dispersed, is supplied to the developing roller 302 can be avoided.

The mixture of the supplementary toner and the developer used for development and having a low toner concentration is agitated and fed to the inner side of the developing device 4 by the developer agitating member 305. Thus, the toner concentration of the developer is normalized, and the revived developer is fed through the developer supplying passage 304P while being supplied to the developing roller 302 to be used for development.

In the developing device 4 illustrated in FIG. 8, the developer in the developer supplying passage 304P is fed to the front side from the inner side thereof while being drawn by the developing roller 302. The developer thus drawn by the developing roller 302 passes through the gap between the developing roller 302 and the developer layer thickness controlling member 303. The developer layer on the developing roller 302 forms magnet brushes, and the magnet brushes are contacted with the photoreceptor 1 for developing an electrostatic latent image formed on the photoreceptor 1. The developer used for development is fed to the inner side of the developing device 4 by the developer agitating member 305.

Thus, the developer is circulated in the developing device 4 as indicated by the arrows D11, D14, D12 and D13 in FIGS. 9 and 10. Since the developer in the developer supplying passage 304P is used for development before fed to the front side of the developing device 4, the amount of the developer fed to the inner side of the developing device 4 by the developer agitating member 305 is large. Therefore, the developer tends to stay at the inner side of the developing device. The thus staying developer prevents smooth circulation of the developer in the developing device 4.

Occurrence of such a circulation problem can be prevented by enhancing the developer feeding ability (per unit time) of the developer supplying member 304 so as to be greater than that of the developer agitating member 305. By using this method, the amount of the developer fed by the developer agitating member 305 can be balanced with the amount of the developer fed by the developer supplying member 304 at the inner side of the developing device 4, and thereby the developer is stably circulated smoothly in the developing device 4 over a long period of time.

Specifically, for example, by increasing the diameter of the screw of the developer supplying member 304 so as to be greater than that of the screw of the developer agitating member 305, the developer feeding ability of the developer supplying member 304 can be enhanced so as to be greater than that of the developer agitating member 305. The same effect can be produced by increasing the spiral pitch of the screw of the developer supplying member 304, increasing the revolution of the screw or enlarging the space of the developer supplying passage 304P.

Figure 11:
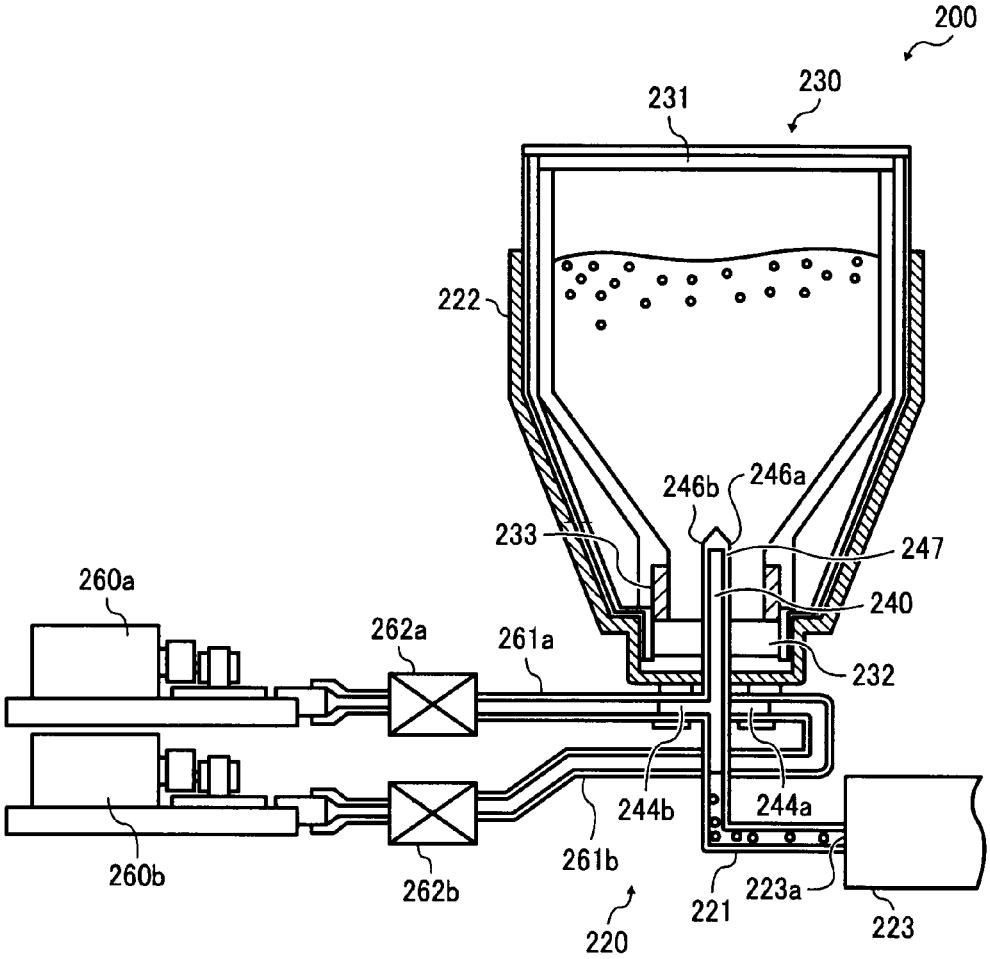
FIG. 11 is a schematic cross-sectional view illustrating a developer supplying device for use in an image forming apparatus of the present invention.

In this example, the supplementary toner is contained in a container 230 illustrated in FIG. 11. The supplementary toner in the container 230 is fed to the developing device 4.

The developer in the developing device 4 includes a toner (T) and a carrier (C) in a weight ratio (T/C) of from 2/98 to 15/85. When the weight ratio (T/C) is greater than 15/85, a toner scattering problem in that the toner in the developer in the developing device 4 is scattered, resulting in contamination of parts of the image forming apparatus, thereby causing abnormal images tends to be caused. By contrast, when the weight ratio (T/C) is less than 2/98, the amount of charge of the toner is excessively increased or the amount of toner supplied to the developing device is decreased, resulting in formation of low density images.

The image forming apparatus of the present invention has a developer supplying device 200 to feed the supplementary toner, which is contained in a deformable container 231 as illustrated in FIG. 11, to the developing device 4 using a screw pump 223, which sucks the supplementary toner in the deformable container 231.

Next, the configuration of the developer supplying device 200 will be described in detail by reference to FIGS. 11-15.

FIG. 11 is a schematic view illustrating a developer supplying device 200 for use in an image forming apparatus of the present invention. The developer supplying device 200 includes the developer container 230 including the deformable (shrinkable) container 231 containing a supplementary toner. As the supplementary toner is supplied from the deformable container 231 to the developing device, the container 231 shrinks due to decrease of the pressure therein.

A developer feeder 220 includes the screw pump 223 connected with a supply opening 15*a* (illustrated in FIG. 13) provided on a predetermined position of the housing of the developing device 4, a nozzle 240 connected with the screw pump, and an air supplier connected with the nozzle 240. The developer feeder 220 is driven so as to feed a proper amount of supplementary toner from the developer container 230 to the developing device 4 upon receipt of a detection signal from a toner concentration sensor (not shown) provided on the developing device 4.

The screw pump 223 and the nozzle 240 are connected with a feed tube 221 serving as a developer feeding passage. The feed tube 221 is preferably made of a flexible material having a good toner resistance such as polyurethane rubbers, nitrile rubbers, and EPDM rubbers.

The developer supplying device 200 includes a holder 222 to support the developer container 230. The holder 222 is made of a rigid material such as resins.

The developer container 230 includes the deformable container 231, which is a bag made of a soft sheet material, and a mouthpiece 232 forming a toner discharging opening.

The material used for forming the deformable container 231 is not particularly limited, but materials having good dimensional stability are preferably used. Specific examples of such materials include resins such as polyester resins, polyethylene resins, polypropylene resins, polystyrene resins, polyvinyl chloride resins, acrylic resins, polycarbonate resins, ABS resins, polyacetal resins, and the like.

A seal member 233 made of a material such as sponges and rubbers and having a cross-shaped cutting is provided on the mouthpiece 232. By inserting the nozzle 240 of the developer feeder 220 into the cross-shaped cutting, the developer container 230 is fixedly connected with the developer feeder 220.

In this example, the developer container 230 is set such that the mouthpiece 232 is located at the bottom of the developer container 230 as illustrated in FIG. 11, but the setting position of the developer container is not limited thereto. The developer container 230 may be horizontally or obliquely set.

The developer container 230 is replaced with a new container when the toner therein is exhausted. Since the container 230 has the above-mentioned configuration, the replacement operation can be easily performed while preventing leakage of the toner from the container when the container is replaced or the toner in the container is supplied to the developing device.

The size, shape, structure and constitutional material of the deformable container 231 are not particularly limited, and these factors are properly determined so that the container fulfills the purpose thereof.

The developer container 230 can be easily attached to or detached from the developer supplying device 200 of the image forming apparatus while having a good combination of preservation property, transport property and handling property.

Figure 12A:
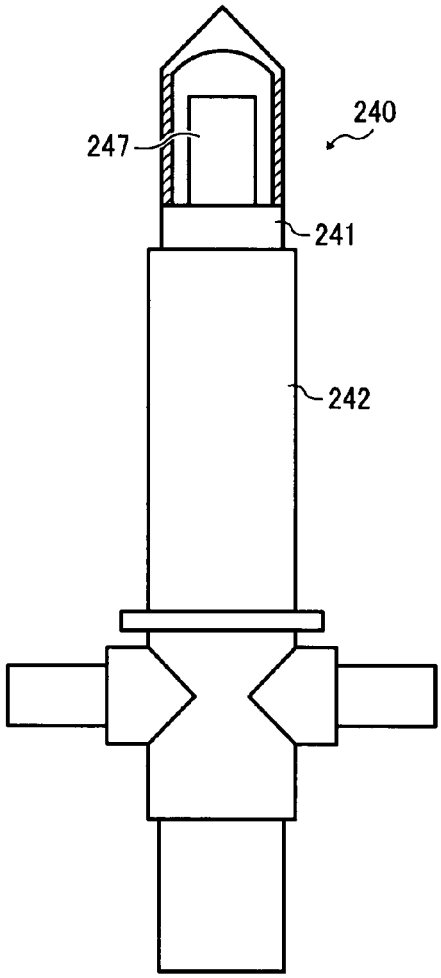
FIGS. 12A-12C are cross-sectional schematic views illustrating a nozzle of the developer supplying device illustrated in FIG. 11.
Figure 12B:
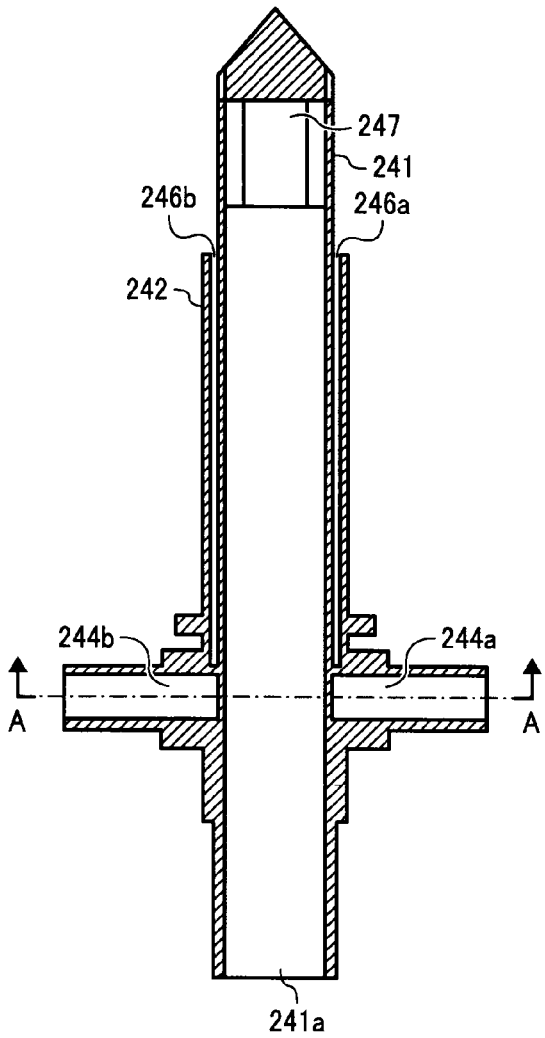
Figure 12C:
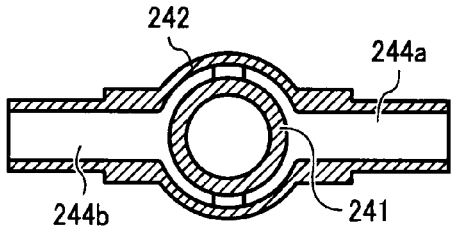

FIGS. 12A and 12B are respectively a front view and a cross-sectional view illustrating the nozzle 240 of the developer feeder 220. In addition, FIG. 12C is a cross-sectional view of the nozzle 240 along a line A.

As illustrated in FIG. 12B, the nozzle 240 has a double tube structure, and has an inner tube 241, and an outer tube 242 containing the inner tube 241 therein. The developer in the developer container 230 is fed through the inner tube 241, i.e., the inner tube 241 serves as a developer feeding passage 241*a*. Specifically, the developer in the developer container 230 is drawn into the screw pump 223 through the developer feeding passage 241*a* by the sucking force of the pump 223.

Figure 13:
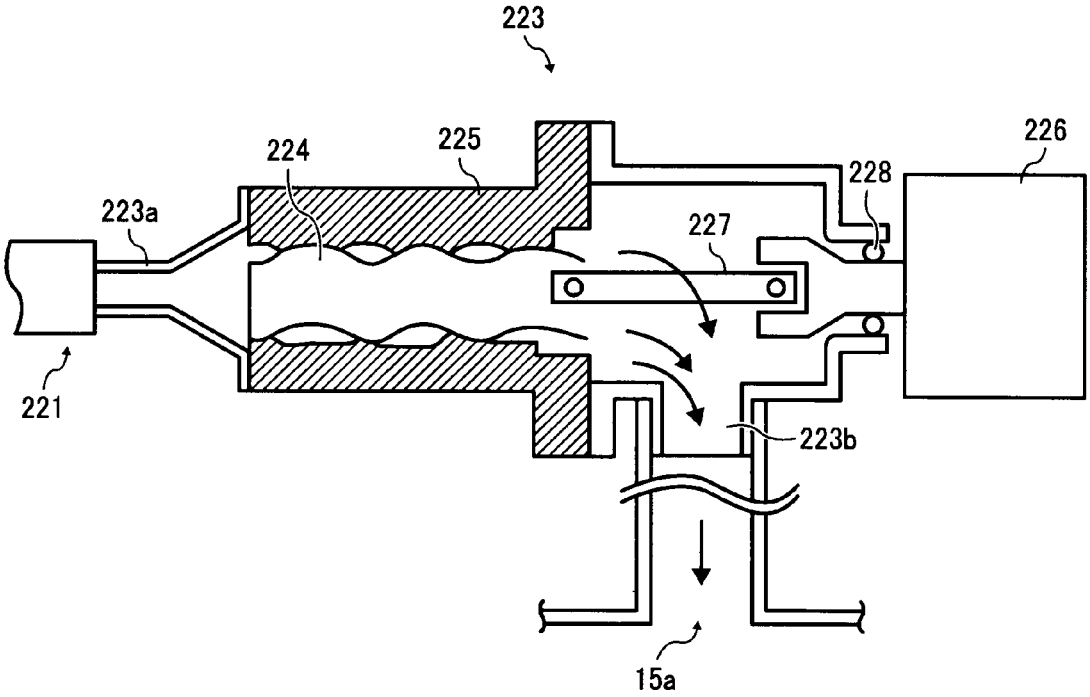
FIG. 13 is a schematic cross-sectional view illustrating a screw pump of the developer supplying device illustrated in FIG. 11.

FIG. 13 is a cross-sectional view illustrating the screw pump 223. The screw pump 223 is called a uniaxial eccentric screw pump, and has a rotor 224 and a stator 225 therein. The rotor 224 has a circular spiral form and is made of a hard material. The rotor 224 is engaged with the inner surface of the stator 225. By contrast, the stator 225 is made of a soft material such as rubbers and has a cavity which has an oval form while being twisted spirally and with which the rotor 224 is engaged. In this regard, the pitch of the spiral stator 225 is twice the pitch of the spiral rotor 224. The rotor 224 is connected with a driving motor 226 via a universal joint 227 and a bearing 228 so as to be rotated.

The developer in the developer container 230 is fed through the developer feeding passage 241*a* of the nozzle 240 and the feed tube 221, and enters into a space of the screw pump 223 formed by the rotor 224 and the stator 225 from an entrance 223*a* of the screw pump 223. The developer is fed rightwards in FIG. 11 through the space by rotation of the rotor 224 and suction force of the pump 223. The thus fed developer then falls from an exit 223*b* as illustrated by arrows in FIG. 13. The developer is then fed to the developing device 4 through the supply opening 15*a*.

The developer supplying device 220 has an air supplying device to supply air to the developer container 230.

Referring to FIG. 11, air flow passages 244*a* and 244*b* are connected with respective air pumps 260*a* and 260*b*, which serve as air suppliers, via respective air supply passages 261*a* and 261*b*.

As illustrated in FIG. 12B, the air flow passage is formed between the inner tube 241 and the outer tube 242, and is constituted of the independent two flow passages 244*a* and 244*b*, which have a semicircular form as illustrated in FIG. 12C.

Specific examples of the air pumps 260*a* and 260*b* include diaphragm air pumps. Air supplied by the air pumps 260*a* and 260*b* is supplied to the container 230 from air supplying openings 246*a* and 246*b* through the air flow passages 244*a* and 244*b*. As illustrated in FIG. 12B, the air supplying openings 246*a* and 246*b* are located below a developer exit 247 of the developer feeding passage 241*a*. Therefore, air supplied from the air supplying openings 246*a* and 246*b* is supplied to a portion of the developer located in the vicinity of the developer exit 247. Therefore, even when the developer in the developer container 230 is aggregated because of being left for a long period of time without being used, and thereby the developer exit 247 is clogged, the aggregated developer can be dissociated by the air supplied by the air pumps 260*a* and 260*b*. Accordingly, the toner can be satisfactorily fed from the container 230 to the developing device 4.

In addition, opening and closing valves 262*a* and 262*b* are provided on the air supply passages 261*a* and 261*b* as illustrated in FIG. 11. The valves 262*a* and 262*b* are opened upon receipt of an ON signal from a controller (not shown) to flow air, and are closed upon receipt of an OFF signal from the controller to stop airflow.

The operation of the developer supplying device 220 will be described by reference to FIG. 11.

When the controller receives a signal from the developing device 4 such that the developer has a low toner concentration, the controller orders the developer supplying device 220 to perform a developer supplying operation. Specifically, initially the air pumps 260*a* and 260*b* are operated to supply air to the container 230 while the driving motor 226 of the screw pump 223 is driven to suck the developer in the container 230.

When air is supplied to the developer container 230 by the air pumps 260*a* and 260*b* through the air supply passages 261*a* and 261*b* and the air flow passages 244*a* and 244*b*, the toner in the container 230 is agitated and fluidized by the air.

In addition, when air is supplied to the container 230, the internal pressure of the container 230 is increased so as to be higher than the atmospheric pressure. Therefore, the fluidized developer is moved toward the low pressure side. Specifically, the developer in the container 230 is discharged from the developer exit 247. In this example, since the developer is also sucked by the screw pump 223, the toner in the developer container 230 can be smoothly discharged from the developer exit 247.

The supplementary toner thus flown out of the developer container 230 is fed to the screw pump 223 via the developer feeding passage 241*a* and the feed tube 221. The supplementary toner is fed by the screw pump 223 and then falls from the pump exit 223*b*, thereby supplying the supplementary toner to the developing device 4 through the developer entrance 15*a*. After a predetermined amount of developer is supplied to the developing device 10 through the developer exit 223*b* by the screw pump 223, the controller stops the operations of the air pumps 260*a* and 260*b* and the driving motor 226 while shutting the valves 262*a* and 262*b*. Thus, the developer supplying operation is completed. By shutting the valves 262*a* and 262*b*, occurrence of a problem in that the developer in the container 230 is reversely fed to the air pumps 260*a* and 260*b* through the air supply passages 244*a* and 244*b* can be prevented.

The amount of air fed by the air pumps is controlled so as to be smaller than the total amount of air and developer sucked by the screw pump 223. Therefore, as the amount of the developer in the container 230 decreases, the internal pressure of the container 230 is reduced. Since the deformable container 231 is made of a soft sheet material, the volume of the container 231 is reduced as the internal pressure thereof is reduced.

Figure 14:
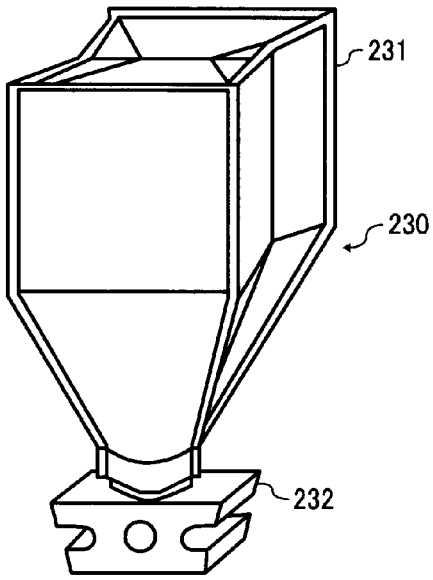
FIG. 14 is a schematic perspective view illustrating a developer container of a developer supplying device, which is filled with a supplementary toner.
Figure 15:
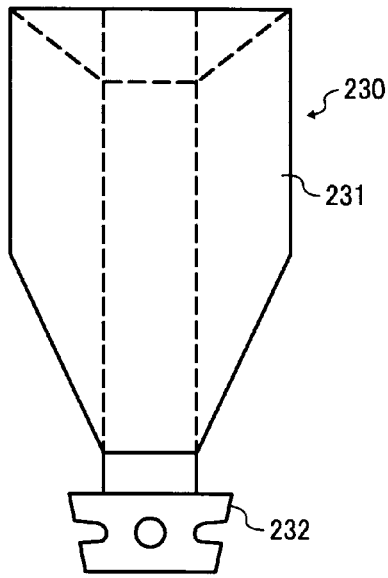
FIG. 15 is a schematic view illustrating the developer container, which is shrunk because the supplementary toner therein is fed to the developing device.

FIG. 14 is a schematic perspective view of the deformable container filled with the developer. FIG. 15 is a schematic front view of the deformable container 231, which is shrunk because the developer therein is discharged therefrom. In this regard, it is preferable for the container 231 to reduce its volume by 60% or more.

The image forming apparatus of the present invention is not limited to the above-mentioned image forming apparatus, and image forming apparatus having the same functions can also be used therefor.

Figure 16:
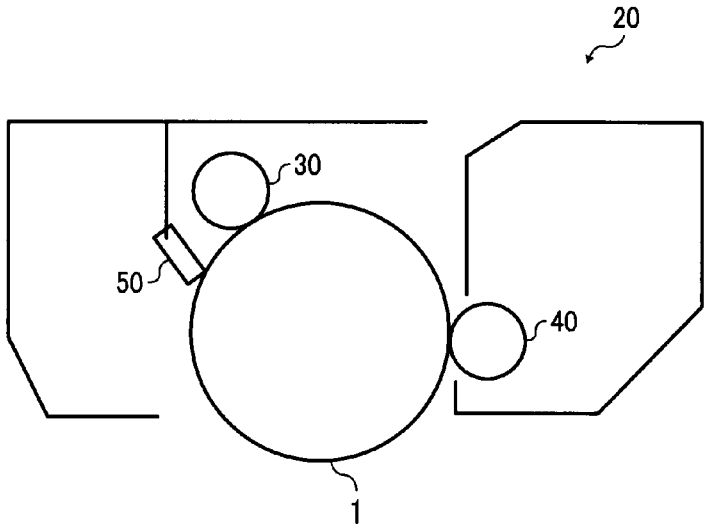
FIG. 16 is a schematic view illustrating an example of a process cartridge of the present invention.

FIG. 16 illustrates an example of the process cartridge of the present invention. Referring to FIG. 16, a process cartridge 20 includes the photoreceptor 1 serving as an image bearing member, a short-range brush charger 30 to charge the photoreceptor 1, a developing device 40 to develop an electrostatic latent image on the photoreceptor 1 using the developer, which includes the toner and the carrier mentioned above for use in the present invention, to form a toner image on the photoreceptor 1, a cleaner 50 to clean the surface of the photoreceptor 1 after transferring the toner image onto a recording material or an intermediate transfer medium, wherein these devices are integrated into a single unit. The process cartridge 20 can be detachably attachable to an image forming apparatus as a single unit. The process cartridge of the present invention includes at least an image bearing member, and a developing device, which is the developing device for use in the present invention.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

1. Preparation of Polyester Resins for Use Tn toners 1-1. Preparation of Polyester Resin A The following components were fed into a 5-liter autoclave equipped with a distillation column so that the total weight of the components was 4,000 g.

| Alcoholic components | |
|---|---|
| Polyoxypropylene(2.3)-2,2-bis(4-hydroxyphenyl)propane (BPA-PO) | 62% by mole |
| Ethylene glycol | 38% by mole |
| **Carboxylic acid components** | |
| Adipic acid | 5% by mole |
| Terephthalic acid | 55% by mole |
| Isophthalic acid | 40% by mole |

In this regard, the molar ratio of the alcoholic components to the carboxylic acid components was 1/1.

The mixture was subjected to an esterification reaction at a temperature of from 170° C. to 260° C. under normal pressure without using a catalyst. Next, antimony trioxide in an amount of 400 ppm based on the total weight of the carboxylic acid components was added to the reaction product. The mixture was subjected to a polycondensation reaction at 250° C. under a reduced pressure of 3 torr (i.e., mmHg) while removing the glycols from the reaction system, resulting in preparation of a polyester resin A. The crosslinking reaction was continued until the react ion product had an agitation torque of 10 kg·cm (when measured at a revolution of 100 rpm). The reaction was stopped by cancelling decompression of the autoclave.

1-2 Preparation of Polyester Resin B

The procedure for preparation of the polyester resin A was repeated except that the alcoholic components and the carboxylic acid components were changed as follows.

| Alcoholic components | |
|---|---|
| Polyoxypropylene(2.3)-2,2-bis(4-hydroxyphenyl)propane (BPA-PO) | 59% by mole |
| Ethylene glycol | 41% by mole |
| **Carboxylic acid components** | |
| Adipic acid | 4% by mole |
| Terephthalic acid | 56% by mole |
| Isophthalic acid | 39% by mole |
| Trimellitic acid | 1% by mole |

Thus, a polyester resin B was prepared.

1-3 Preparation of Polyester Resin C

The procedure for preparation of the polyester resin A was repeated except that the alcoholic components and the carboxylic acid components were changed as follows.

| Alcoholic components | |
|---|---|
| Polyoxypropylene(2.3)-2,2-bis(4-hydroxyphenyl)propane (BPA-PO) | 57% by mole |

-continued

| | |
|---|---|
| Ethylene glycol | 42% by mole |
| Glycerin | 1% by mole |
| Carboxylic acid components | |
| Adipic acid | 6% by mole |
| Terephthalic acid | 55% by mole |
| Isophthalic acid | 39% by mole |

Thus, a polyester resin C was prepared.

1-4 Preparation of Polyester Resin D

The procedure for preparation of the polyester resin A was repeated except that the alcoholic components and the carboxylic acid components were changed as follows.

| | |
|---|---|
| Alcoholic components | |
| Polyoxyethylene(2.3)-2,2-bis(4-hydroxyphenyl)propane (BPA-EO) | 55% by mole |
| Ethylene glycol | 40% by mole |
| Glycerin | 5% by mole |
| Carboxylic acid components | |
| Adipic acid | 5% by mole |
| Terephthalic acid | 55% by mole |
| Isophthalic acid | 40% by mole |

Thus, a polyester resin D was prepared.

1-5 Preparation of Polyester Resin E

The procedure for preparation of the polyester resin A was repeated except that the alcoholic components and the carboxylic acid components were changed as follows.

| | |
|---|---|
| Alcoholic components | |
| Polyoxyethylene(2.3)-2,2-bis(4-hydroxyphenyl)propane (BPA-EO) | 52% by mole |
| Ethylene glycol | 41% by mole |
| Glycerin | 7% by mole |
| Carboxylic acid components | |
| Adipic acid | 4% by mole |
| Terephthalic acid | 55% by mole |
| Isophthalic acid | 41% by mole |

Thus, a polyester resin E was prepared.

The thus prepared polyester resins A-E were evaluated with respect to the following properties.

(1) Softening Point

A flow tester, CFT-500D from Shimadzu Corp., was used to measure the softening point. Specifically, one gram of a resin was heated at a temperature rising speed of 6° C./min while applying a pressure of 1.96 MPa to the resin with a plunger so that the melted resin be extruded from a nozzle having a length of 1 mm and a diameter of 1 mm. A graph showing the relation between the temperature and the amount of decent of the plunger was prepared, and the softening point of the resin was determined as the temperature, at which the amount of decent of the plunger is ½ (i.e., half the resin (0.5 g of the resin) has been flown out of the nozzle).

(2) Glass Transition Temperature (Tg)

A differential scanning calorimeter (DSC), DSC210 from Seiko instruments Inc., was used to measure the glass transition temperature. Specifically, 0.01 to 0.02 g of a resin was set on an aluminum pan, and the resin was heated to 200° C. in the differential scanning calorimeter. After the resin was cooled to 0° C. at a temperature falling speed of 10° C./m, the resin was heated again to 200° C. at a temperature rising speed of 10° C./m while recording a DSC curve. The glass transition temperature (Tg) was determined as the temperature, at which an extension of the base line of the DSC curve in a temperature range lower than the maximum endothermic peak crosses the rising portion of the maximum endothermic peak (i.e., a tangent to a curve of from a rise start point of the maximum endothermic peak to the top of the peak).

(3) Acid Value (AV)

The acid value of a resin was measured by the method of JIS K0070 except that the solvent (i.e., a mixture solvent of ethanol and ether) was replaced with a mixture solvent of acetone and toluene in a volume ratio of 1/1.

(4) Loss Tangent Peak Temperature (tan δ Peak Temp.)

The loss tangent (tan δ) of a resin was measured with an instrument, ADVANCED RHEOMETRIC EXPANSION SYSTEM from TA. Specifically, the method is as follows.

1) 0.8 grams of a resin is pelletized using a die having a diameter of 20 mm upon application of pressure of 30 MPa thereto; and 2) the loss modulus (G"), the storage modulus (G') and the loss tangent (tan δ) of the resin are measured using the instrument with a parallel cone having a diameter of 20 mm under the following conditions:

Frequency: 1.0 Hz

Temperature rising speed 2.0° C./min

Strain: 0.1% (automatic strain control, allowable minimum stress: 1.0 g/cm, allowable maximum stress: 500 g/cm, maximum applied strain: 200%, strain adjustment 200%)

GAP: The GAP was controlled by an operator such that "FORCE" in a PC screen falls in a range of from 0 to 100 gm after setting the sample.

The temperature (i.e., the loss tangent peak temperature), at which a loss tangent peak is observed, was determined. In this regard, the data of the loss tangent obtained when the storage modulus (G') is not greater than 10 are excluded.

(5) Molecular Weights (Mw and Mn)

The number average molecular weight (Mn) and the weight average molecular weight (Mw) of tetrahydrofuran-soluble components of a resin were measured with a combination of an instrument using gel permeation chromatography (GPC), GPC-150C (Waters Corp.) and columns KF801-807 from Showa Denko K.K. The measuring method is as follows.

1) The columns are stabilized at 40° C. in a heat chamber;

2) Tetrahydrofuran is fed to the columns at a flow rate of 1 ml/min;

3) 0.05 g of a sample (resin) is dissolved in 5 g of tetrahydrofuran and the solution is filtered using a filter (such as filters having pore size of 0.45 μm (e.g., CHOROMATODISK from Kurabo Industries Ltd.), and then diluted to prepare a THF solution of the resin having a solid content of from 0.05 to 0.6% by weight;

4) 50 to 200 μl of the solution is fed to the columns to measure the weight average molecular weight (Mw) and the number average molecular weight (Mn) of the resin using a working curve showing relation between counts and amounts and prepared by using monodisperse polystyrenes.

The monodisperse polystyrenes prepared by Tosoh Corp., and having different molecular weights, $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, were used for preparing a working curve. In measurements, a RI (refractive index) detector was used as the detector.

The formula and properties of the polyester resins are shown in Table 1 below.

TABLE 1

| Formula and properties of polyester resins | | Polyester resins A | B | C | D | E |
|---|---|---|---|---|---|---|
| Alcoholic components | BPA-PO (% by mole) | 62 | 59 | 57 | — | — |
| | BPA-EO (% by mole) | — | — | — | 55 | 52 |
| | Ethylene glycol (% by mole) | 38 | 41 | 42 | 40 | 41 |
| | Glycerin (% by mole) | — | — | 1 | 5 | 7 |
| | Adipic acid (% by mole) | 5 | 4 | 6 | 5 | 4 |
| | Terephthalic acid (% by mole) | 55 | 56 | 55 | 55 | 55 |
| | Isophthalic acid (% by mole) | 40 | 39 | 39 | 40 | 41 |
| | Trimellitic acid (% by mole) | — | 1 | — | — | — |
| | Softening point (° C.) | 110.4 | 122.1 | 119.3 | 120.8 | 120.1 |
| | Tg (° C.) | 64.0 | 67.5 | 63.0 | 60.3 | 62.4 |
| | Tan δ peak temp. (° C.) | 143.0 | 156.5 | 136.5 | 137.0 | 111.0 |
| | AV (mgKOH/g) | 7.0 | 6.6 | 6.6 | 6.8 | 7.0 |
| | Mw | 15300 | 18700 | 19600 | 19840 | 20800 |
| | Mn | 3800 | 4900 | 3200 | 3580 | 3580 |

2. Preparation of Crystalline Polyester Resins 2-1. Preparation of Crystalline Polyester Resin A The following components were fed into a 5-liter four-necked round-bottom flask equipped with a thermometer, an agitator, a condenser and a nitrogen feed pipe to be mixed.

| Alcoholic components | |
|---|---|
| 1,4-Butanediol | 100% by mole |
| **Carboxylic acid components** | |
| Fumaric acid | 90% by mole |
| Succinic acid | 5% by mole |
| Trimellitic acid | 5% by mole |

In this regard, the molar ratio of the alcoholic components to the carboxylic acid components was 1/1.

The total weight of these components was 4,000 g. In addition, 4 g of hydroquinone was added thereto.

After the flask was set in a mantle heater while a nitrogen gas was fed into the flask so that the atmosphere inside the flask was changed to inert atmosphere, the flask was heated to 160° C. to perform a reaction for 5 hours, followed by a further reaction for 1 hour at 200° C., and an additional reaction for 1 hour at 200° C. under a pressure of 8.3 kPa. Thus, a crystalline polyester resin A was prepared.

2-2 Preparation of Crystalline Polyester Resin B

The procedure for preparation of the crystalline polyester resin A was repeated except that the alcoholic components and the carboxylic acid components were changed as follows.

| Alcoholic components | |
|---|---|
| 1,5-Pentanediol | 90% by mole |
| 1,6-hexanediol | 10% by mole |
| **Carboxylic acid components** | |
| Succinic acid | 5% by mole |
| Trimellitic acid | 5% by mole |
| Terephthalic acid | 90% by mole |

Thus, a crystalline polyester resin B was prepared.

The thus prepared crystalline polyester resins A and B were evaluated as follows.

(1) Softening Point

The above-mentioned softening point measuring method was used.

The formula and property of the crystalline polyester resins are shown in Table 2 below.

TABLE 2

| Formula and property of crystalline polyester resins | | Crystalline polyester A | Crystalline polyester B |
|---|---|---|---|
| Alcoholic components | 1,4-butanediol (% by mole) | 100 | — |
| | 1,5-pentanediol (% by mole) | — | 90 |
| | 1,6-hexanediol (% by mole) | — | 10 |
| Carboxylic acid components | Fumaric acid (% by mole) | 90 | — |
| | Succinic acid (% by mole) | 5 | 5 |
| | Trimellitic acid (% by mole) | 5 | 5 |
| | Terephthalic acid (% by mole) | — | 90 |
| Softening point (° C.) | | 70 | 111 |

3. Preparation of Transparent Toners 3-1 Preparation of Transparent Toner 1

The following components were mixed using a HENSCHEL MIXER mixer (FM20B from NIPPON COKE & ENGINEERING CO., LTD.).

| | |
|---|---|
| Polyester resin A | 100 parts |
| Crystalline polyester resin A | 15 parts |
| Carnauba wax (CARNAUBA WAX No. 1 from CERARICA NODA Co., Ltd.) | 5 parts |
| Ethylenebisstearamide (EB-P from Kao Corp.) | 2 parts |

The toner component mixture was kneaded in a temperature range of from 100 to 130° C. using a twin-screw extruder, PCM-30 from Ikegai Corp. After the kneaded toner component mixture was cooled to room temperature, the solidified toner component mixture was crushed using a hammer mill so as to have a particle size of from 200 to 300 μm. The crushed toner component mixture was pulverized using a supersonic jet pulverizer (LABOJET from Nippon Pneumatic Mfg. Co., Ltd.) while controlling the air pressure, followed by classification using an airflow classifier (MDS-1 from Nippon Pneumatic Mfg. Co., Ltd.) while controlling the angle of the louver so that the resultant toner particles have a weight average particle diameter of 6.0±0.2 μm, and a ratio (Dw/Dn) (weight average particle diameter (Dw)/number average particle diameter (Dn)) of not greater than 1.20. Thus, a mother toner (i.e., toner particles) of a transparent toner 1 was prepared.

The following components were mixed using a HENSCHEL MIXER mixer.

| | |
|---|---|
| Mother toner prepared above | 100 parts |
| External additive (silica, HDK-2000 from Clariant Japan, K.K.) | 1.0 part |

Thus, the transparent toner 1 was prepared.

3-2 Preparation of Transparent Toner 2

The procedure for preparation of the transparent toner 1 was repeated except that the added amount of the crystalline polyester resin A was changed from 15 parts to 30 parts.

Thus, a transparent toner 2 was prepared.

3-3 Preparation of Transparent Toner 3

The procedure for preparation of the transparent toner 1 was repeated except that the toner components were replaced with the following components.

| | |
|---|---|
| Polyester resin B | 100 parts |
| Carnauba wax (CARNAUBA WAX No. 1 from CERARICA NODA Co., Ltd.) | 5 parts |

Thus, a transparent toner 3 was prepared.

3-4 Preparation of Transparent Toner 4

The procedure for preparation of the transparent toner 1 was repeated except that the toner components were replaced with the following components.

| | |
|---|---|
| Polyester resin B | 100 parts |
| Carnauba wax (CARNAUBA WAX No. 1 from CERARICA NODA Co., Ltd.) | 3 parts |

Thus, a transparent toner 4 was prepared.

3-5 Preparation of Transparent Toner 5

The procedure for preparation of the transparent toner 1 was repeated except that the toner components were replaced with the following components.

| | |
|---|---|
| Polyester resin A | 100 parts |
| Crystalline polyester resin B | 20 parts |

Thus, a transparent toner 5 was prepared.

3-6 Preparation of Transparent Toner 6

| | |
|---|---|
| Water | 100 parts |
| Aqueous dispersion of vinyl resin (Copolymer of styrene/methacrylic acid/butyl acrylate/sodium salt of sulfate of ethylene oxide adduct of methacylic acid prepared by Sanyo Chemical Industries Ltd., solid content of 20% by weight) | 10 parts |
| Aqueous solution of a sodium salt of dodecyldiphenyletherdisulfonic acid (ELEMINOL MON-7 from Sanyo Chemical Industries Ltd., solid content of 50%) | 20 parts |
| 1% aqueous solution of polymeric protective colloid (Carbomethyl cellulose, CELLOGEN BSH from Dai-ichi Kogyo Seiyaku Co., Ltd.) | 40 parts |
| Ethyl acetate | 15 parts |

Thus, a milk white liquid (i.e., aqueous phase liquid) was prepared.

The following components were fed into a container equipped with an agitator and a thermometer.

| | |
|---|---|
| Polyester resin A | 250 parts |
| Carnauba wax | 40 parts |
| Ethyl acetate | 200 parts |

The mixture was heated to 80° C. while agitated. After the mixture was heated for 5 hours at 80° C., the mixture was cooled to 30° C. over 1 hour, and then subjected to a dispersing treatment using a bead mill (ULTRAVISCOMILL from Aimex Co., Ltd.). The dispersing conditions were as follows.

Liquid feeding speed: 1.2 kg/hour

Peripheral speed of disc: 10 m/sec

Dispersing media: zirconia beads with a diameter of 0.5 mm

Filling factor of beads: 80% by volume

Repeat number of dispersing operation: 5 times (5 passes)

Thus, a wax dispersion was prepared.

Next, the following components were fed into a container.

| | |
|---|---|
| Aqueous phase liquid prepared above | 1250 parts |
| Wax dispersion prepared above | 1110 parts |
| 50% ethyl acetate solution of prepolymer (number average molecular weight of 6,500 glass transition temperature (Tg) of 55° C., and free isocyanate content of 1.5% by weight) | 130 parts |
| Isobutyl alcohol | 1 part |
| Isophorone diamine | 7 parts |
| Emulsion stabilizer (UCAT660M from Sanyo Chemical Industries Ltd.) | 5 parts |

The mixture was agitated for 30 minutes at 28° C. using a TK HOMOMIXER mixer from Tokushu Kika Kogyo Co., Ltd., whose rotor was rotated at a revolution of 9,000 rpm. Thus, an emulsion was prepared.

After the emulsion was heated to 58° C., the emulsion was further dispersed for 1 hour using the TK HOMOMIXER mixer, whose rotor was rotated at a revolution of 1,500 rpm. Thus, a slurry-like emulsion was prepared.

The slurry-like emulsion was fed into a container equipped with an agitator and a thermometer, and agitated for 10 hours at 35° C. to remove the organic solvent therefrom, followed by aging for 12 hours at 45° C. Thus, a dispersion was prepared One hundred (100) parts of the thus prepared dispersion was subjected to filtration under a reduced pressure.

The thus prepared wet cake was mixed with 300 parts of ion-exchange water, and the mixture was agitated for 15 minutes with a TK HOMOMIXER mixer, whose rotor was rotated at a revolution of 6,000 rpm, followed by filtration under a reduced pressure. Thus, a wet cake (a) was prepared.

The thus prepared wet cake (a) was mixed with 100 parts of a 10% aqueous solution of sodium hydroxide, and the mixture was agitated for 15 minutes with the TK HOMOMIXER mixer, whose rotor was rotated at a revolution of 6,000 rpm, followed by filtration under a reduce pressure. Thus, a wet cake (b) was prepared. The wet cake (b) was mixed with 100 parts of a 10% aqueous solution of hydrochloric acid, and the mixture was agitated for 15 minutes with the TK HOMOMIXER mixer, whose rotor was rotated at a revolution of 6,000 rpm, followed by filtration under a reduce pressure. Thus, a wet cake (c) was prepared. The wet cake (c) was mixed with 500 parts of ion-exchange water, and the mixture was agitated for 30 minutes with the TK HOMOMIXER mixer, whose rotor was rotated at a revolution of 6,000 rpm, followed by filtration under a reduced pressure.

The thus prepared wet cake was dried for 24 hours at 40° C. using a circulating air drier, followed by sieving with a screen having openings of 75 μm.

Thus, a mother toner of a transparent toner 6 having a weight average particle diameter of 5.2 μm and a Mw/Mn ratio of 1.14 was prepared.

One hundred (100) parts of the mother toner was mixed with 1.0 part of an additive (silica, HDK-2000 from Clariant Japan K.K.) using a HENSCHEL MIXER mixer.

Thus, the transparent toner 6 was prepared.

3-7 Preparation of Transparent Toner 7

The following components were mixed.

| | |
|---|---|
| Water | 100 parts |
| Aqueous dispersion of vinyl resin (Copolymer of styrene/methacrylic acid/butyl acrylate/sodium salt of sulfate of ethylene oxide adduct of methacrylic acid prepared by Sanyo Chemical Industries Ltd., solid content of 20% by weight) | 10 parts |
| Aqueous solution of a sodium salt of dodecyldiphenyletherdisulfonic acid (ELEMENOL MON-7 from Sanyo Chemical Industries Ltd., solid content of 50%) | 20 parts |
| 1% aqueous solution of polymeric protective colloid | 40 parts |

-continued

| | |
|---|---|
| (Carbomethyl cellulose, CELLOGEN BSH from Dai-ichi Kogyo Seiyaku Co., Ltd.) | |
| Ethyl acetate | 15 parts |

Thus, a milk white liquid (i.e., aqueous phase liquid) was prepared.

The following components were fed into a four-necked flask equipped with a nitrogen feed pipe, a dewatering conduit, an agitator and a thermocouple.

50% ethyl acetate solution of prepolymer 400 parts (prepolymer: reaction product of condensation reaction product of propylene oxide adduct of bisphenol A/adipic acid/terephthalic acid with isophorone diisocyanate, number average molecular weight of 6,500, weight average molecular weight of 18,000, glass transition temperature of 55° C., free isocyanate content of 1.5% by weight)

| | |
|---|---|
| Condensation reaction product of propylenef oxide adduct o bisphenol A with adipic acid (number average molecular weight of 800) | 100 parts |
| Isophorone diamine | 20 parts |
| Ethyl acetate | 50 parts |

The mixture was heated to 100° C. while agitated in a nitrogen atmosphere. After the mixture was subjected to a reaction for 5 hours at 100° C., the organic solvent (ethyl acetate) was removed therefrom under a reduced pressure. Thus, a polyester resin F, which is modified so as to have a urethane bond and/or a urea bond, was prepared. It was confirmed that the polyester resin F has a softening point of 104° C., a glass transition temperature (Tg) of 60° C., an acid value of 18 mgKOH/g, and a hydroxyl value of 45 mgKOH/g.

The following components were fed into a container equipped with an agitator and a thermometer.

| | |
|---|---|
| Polyester resin F | 500 parts |
| Carnauba wax | 40 parts |
| Ethyl acetate | 200 parts |

The mixture was heated to 80° C. while agitated. After the mixture was heated for 5 hours at 80° C., the mixture was cooled to 30° C. over 1 hour, and then subjected to a dispersing treatment using a bead mill (ULTRAVISCOMILL from Aimex Co., Ltd.). The dispersing conditions were as follows.

Liquid feeding speed: 1.2 kg/hour

Peripheral speed of disc: 10 m/sec

Dispersing media: zirconia beads with a diameter of 0.5 mm

Filling factor of beads: 80% by volume

Repeat number of dispersing operation: 5 times (5 passes)

Thus, a wax dispersion was prepared.

The following components were fed into a container.

| | |
|---|---|
| Aqueous phase liquid prepare above | 1420 parts |
| Wax dispersion prepared above | 1420 parts |
| Emulsion stabilizer (UCAT660M from Sanyo Chemical Industries Ltd.) | 5 parts |

The mixture was agitated for 30 minutes at 28° C. using a TK HOMOMIXER mixer (from Tokushu Kika Kogyo Co., Ltd.), whose rotor was rotated at a revolution of 9,000 rpm. Thus, a slurry-like emulsion was prepared.

The slurry-like emulsion was fed into a container equipped with an agitator and a thermometer, and agitated for 10 hours at 35° C., followed by aging for 12 hours at 45° C. to remove the organic solvent therefrom. Thus, a dispersion was prepared One hundred (100) parts of the thus prepared dispersion was subjected to filtration under a reduced pressure.

The thus prepared wet cake was mixed with 300 parts of ion-exchange water, and the mixture was agitated for 15 minutes with a TK HOMOMIXER mixer, whose rotor was rotated at a revolution of 6,000 rpm, followed by filtration under a reduced pressure. Thus, a wet cake (a) was prepared.

The thus prepared wet cake (a) was mixed with 100 parts of a 10% aqueous solution of sodium hydroxide, and the mixture was agitated for 15 minutes with the TK HOMOMIXER mixer, whose rotor was rotated at a revolution of 6,000 rpm, followed by filtration under a reduce pressure. Thus, a wet cake (b) was prepared. The wet cake (b) was mixed with 100 parts of a 10% aqueous solution of hydrochloric acid, and the mixture was agitated for 15 minutes with the TK HOMOMIXER mixer, whose rotor was rotated at a revolution of 6,000 rpm, followed by filtration under a reduce pressure. Thus, a wet cake (c) was prepared. The wet cake (c) was mixed with 500 parts of ion-exchange water, and the mixture was agitated for 30 minutes with the TK HOMOMIXER mixer, whose rotor was rotated at a revolution of 6,000 rpm, followed by filtration under a reduced pressure.

The thus prepared wet cake was dried for 24 hours at 40° C. using a circulating air drier, followed by sieving with a screen having openings of 75 μm.

Thus, a mother toner of a transparent toner 7 having a weight average particle diameter of 5.0 μm and a Mw/Mn ratio of 1.13 was prepared.

One hundred (100) parts of the mother toner was mixed with 1.0 part of an additive (silica, HDK-2000 from Clariant Japan K.K.) using a HENSCHEL MIXER mixer.

Thus, the transparent toner 7 was prepared.

3-8 Preparation of Transparent Toner 8

The procedure for preparation of the transparent toner 1 was repeated except that the toner components were replaced with the following components.

| | |
|---|---|
| Polyester resin C | 100 parts |
| Carnauba wax (CARNAUBA WAX No. 1 from CERARICA NODA Co., Ltd.) | 5 parts |

Thus, a transparent toner 8 was prepared.

3-9 Preparation of Transparent Toner 9

The procedure for preparation of the transparent toner 1 was repeated except that the toner components were replaced with the following components.

| | |
|---|---|
| Polyester resin A | 100 parts |
| Crystalline polyester resin B | 10 parts |
| Carnauba wax (CARNAUBA WAX No. 1 from CERARICA NODA Co., Ltd.) | 5 parts |

Thus, a transparent toner 9 was prepared.

3-10 Preparation of Transparent Toner 10

The procedure for preparation of the transparent toner 1 was repeated except that the toner components were replaced with the following components.

| | |
|---|---|
| Polyester resin A | 100 parts |
| Crystalline polyester resin A | 15 parts |
| Carnauba wax (CARNAUBA WAX No. 1 from CERARICA NODA Co., Ltd.) | 5 parts |
| Stearamide (FATTY ACID AMIDE S from Kao Corp.) | 2 parts |

Thus, a transparent toner 10 was prepared.

3-11 Preparation of Transparent Toner 11

The procedure for preparation of the transparent toner 1 was repeated except that the toner components were replaced with the following components.

| | |
|---|---|
| Polyester resin D | 100 parts |
| Crystalline polyester resin A | 15 parts |
| Carnauba wax (CARNAUBA WAX No. 1 from CERARICA NODA Co., Ltd.) | 5 parts |
| Ethylenebisstearamide (EB-P from Kao Corp.) | 2 parts |

Thus, a transparent toner 11 was prepared.

3-12 Preparation of Transparent Toner 12

The procedure for preparation of the transparent toner 1 was repeated except that the toner components were replaced with the following components.

| | |
|---|---|
| Polyester resin E | 100 parts |
| Crystalline polyester resin A | 15 parts |
| Carnauba wax (CARNAUBA WAX No. 1 from CERARICA NODA Co., Ltd.) | 5 parts |
| Ethylenebisstearamide (EB-P from Kao Corp.) | 2 parts |

Thus, a transparent toner 12 was prepared.

The properties of the transparent toners 1-12 are illustrated in Table 3 below.

TABLE 3

| No of transparent toner | Addition of wax | Addition of crys. PE* | Addition of lubricant*2 | Tan δ peak temp. (° C.) | Loss tangent | Mw of polyester | Mn of polyester | Mw/Mn of polyester |
|---|---|---|---|---|---|---|---|---|
| 1 | Yes | Yes | Yes | 85 | 4 | 15300 | 3800 | 4.03 |
| 2 | Yes | Yes | Yes | 78 | 5 | 15300 | 3800 | 4.03 |
| 3 | Yes | No | No | 156 | 11 | 18700 | 4900 | 3.82 |
| 4 | Yes | No | No | 164 | 11 | 18700 | 4900 | 3.82 |
| 5 | No | Yes | No | 98 | 4 | 15300 | 3800 | 4.03 |
| 6 | Yes | No | No | 145 | 8 | 15300 | 3800 | 4.03 |
| 7 | Yes | No | No | 120 | 2 | — | — | — |
| 8 | Yes | No | No | 158 | 10 | 19600 | 3200 | 6.13 |
| 9 | Yes | Yes | No | 117 | 4 | 15300 | 3800 | 4.03 |
| 10 | Yes | Yes | Yes | 84 | 6 | 15300 | 3800 | 4.03 |
| 11 | Yes | Yes | Yes | 84 | 28 | 19840 | 3580 | 5.54 |
| 12 | Yes | Yes | Yes | 82 | 50 | 20800 | 3580 | 5.81 |

crys. PE*: crystalline polyester
lubricant*2: Fatty acid amide-based lubricant
Yes: The material is included in the toner.
No: The material is not included in the toner.

4. Preparation of Color Toners 4-1 Preparation of Colorant Master Batches

The following components were mixed using a HENSCHEL MIXER mixer from NIPPON COKE & ENGINEERING CO., LTD.

| | |
|---|---|
| Carbon black (REGAL 400R from Cabot Corp.) | 50 parts |
| Polyester resin (RS801 from Sanyo Chemical Industries Ltd.) | 50 parts |
| Water | 30 parts |

The mixture was kneaded for 50 minutes at 160° C. using a two roll mill. The kneaded mixture was subjected to roll cooling, and then pulverized. Thus, a black colorant master batch 1 was prepared.

The procedure for preparation of the black colorant master batch 1 was repeated except that the carbon black was replaced with C. I. Pigment Red 269, C. I. Pigment Blue 15:3, or C. I. Pigment Yellow 155 to prepare a magenta colorant master batch 1, a cyan colorant master batch 1 and a yellow colorant master batch 1.

4-2 Preparation of Color Toners

The procedure for preparation of the transparent toner 1 was repeated except that the toner components were replaced with the following components.

| | |
|---|---|
| Polyester resin A | 92 parts |
| Crystalline polyester resin A | 15 parts |
| Carnauba wax (CARNAUBA WAX No. 1 from CERARICA NODA Co., Ltd.) | 4 parts |
| Black colorant master batch 1 | 16 parts |

Thus, a black toner 1 was prepared.

The procedure for preparation of the black toner 1 was repeated except that the black colorant master batch 1 was replaced with the magenta, cyan or yellow master batch to prepare a magenta toner 1, a cyan toner 1 and a yellow toner 1.

EXAMPLE 1

(1) Preparation of Two-Component Developers

The following components were mixed.

| | |
|---|---|
| Transparent toner 1 | 5 parts |
| Coated ferrite carrier | 95 parts |

The mixture was mixed for 5 minutes using a TURBULA MIXER mixer from Willy A. Bachof en AG (WAB), which was rotated at a revolution of 48 rpm, to charge the toner.

Thus, a developer T1 including the transparent toner 1 was prepared.

The procedure for preparation of the developer T1 was repeated except that the transparent toner 1 was replaced with the black toner 1, the magenta toner 1, the cyan toner 1 or the yellow toner 1 to prepare black, magenta, cyan and yellow developers K1, M1, C1 and Y1.

(2) Preparation of Supplementary Toners

The transparent toner 1, the yellow toner 1, the magenta toner 1, the cyan toner 1, and the black toner 1 were used as the supplementary toners to be supplied to the developing devices from the corresponding developer supplying devices.

The thus prepared toners and developers were evaluated as follows

1. Fixing Property

The developer T1 including the transparent toner 1 was set in the developing unit 105E of the image forming apparatus illustrated in FIG. 4, and the yellow, magenta, cyan and black developers Y1, M1, C1 and K1 were respectively set in the developing units 105A, 105B, 105C and 105D. The developing unit 105E has such a configuration as illustrated in FIG. 5. Each of the developing units 105A-105E is equipped with the developer supplying device 200 illustrated in FIGS. 11-15, and the yellow toner 1, the magenta toner 1, the cyan toner 1, the black toner 1 and the transparent toner 1 were contained in the developer containers 230 of the corresponding developer supplying devices.

By using the image forming apparatus, the image forming processes, i.e., charging, irradiating, developing, transferring and fixing processes, were performed to produce color images in which a solid transparent image with a weight of 0.4 mg/cm$^2$ was formed on a solid color toner image with a weight of 0.4 mg/cm$^2$. The image forming conditions were as follows.

Image forming speed (linear speed): 160 mm/sec

Fixing temperature: 130 to 210° C. (standard temperature: 190° C.)

Fixing nip width: 11 mm

Recording paper: POD GLOSS COAT PAPER from Oji Paper Co., Ltd., which has a weight of 128 g/m$^2$ In order to evaluate the fixability of toner, the following properties were evaluated.

(1) Low Temperature Fixability

Images were produced while changing the fixing temperature from 130 to 200° C. at an interval of 5° C. The produced images were visually observed to determine whether the toners cause a cold offset phenomenon and a hot offset phenomenon (i.e., to evaluate the low temperature fixability and the hot offset resistance of the toner). The low temperature fixability of toner is graded as follows.

◎: The cold offset temperature of the toner is lower than 130° C. (excellent)

○: The cold offset temperature of the toner is lower than 140° C. and not lower than 130° C. (good)

□: The cold offset temperature of the toner is lower than 150° C. and not lower than 140° C. (fair)

Δ: The cold offset temperature of the toner is lower than 160° C. and not lower than 150° C. (acceptable)

X: The cold offset temperature of the toner is not lower than 160° C. (bad)

(2) Hot Offset Resistance

The procedure for evaluation of the low temperature fixability was repeated, and the produced images were visually observed to determine whether the toners cause the hot offset phenomenon. The hot offset resistance of toner is graded as follows.

◎: The hot offset temperature of the toner is higher than 200° C. (excellent)

○: The hot offset temperature of the toner is higher than 190° C. and not higher than 200° C. (good)

□: The hot offset temperature of the toner is higher than 180° C. and not higher than 190° C. (fair)

Δ: The hot offset temperature of the toner is higher than 170° C. and not higher than 180° C. (acceptable)

X: The hot offset temperature of the toner is not higher than 170° C. (bad)

(3) Glossiness of Fixed Toner Images

The glossiness (60° glossiness) of the fixed toner images was measured with a gloss meter VGS-1D from Nippon Denshoku Industries Co., Ltd. The glossiness property of toner is graded as follows.

◎: The glossiness of the fixed toner image is not lower than 80%. (excellent)

○: The glossiness of the fixed toner image is not lower than 60% and lower than 80%. (good)

Δ: The glossiness of the fixed toner image is not lower than 40% and lower than 60%. (acceptable)

X: The glossiness of the fixed toner image is lower than 40%. (bad)

(4) Unevenness of Glossiness of Fixed Toner Images

A running test, in which 1,000 copies of an original image are continuously produced, was performed on each of the developers while supplying the corresponding supplementary toner, and the last image was visually observed to determine unevenness of glossiness of the image. The unevenness of glossiness is graded as follows.

◎: The fixed toner image has no unevenness of glossiness. (excellent)

○: The fixed toner image has slight unevenness of glossiness. (good)

Δ: The fixed toner image has unevenness of glossiness on an acceptable level. (acceptable)

X: The fixed toner image has serious unevenness of glossiness. (bad)

3. Preservation Property of the Toners

Ten (10) grams of each of the toners was fed into a 30 ml screw vial, and the screw vial was tapped 100 times by a tapping machine. After the screw vial containing the toner was preserved for 24 hours at 45° C. and then cooled to room temperature, the penetration of the toner was measured using a penetration tester. The preservation property of the toner is graded as follows.

○: The penetration of the toner is not lower than 10 mm. (good)

Δ: The penetration of the toner is not lower than 10 mm and is lower than 15 mm. (acceptable)

X: The penetration of the toner is lower than 10 mm. (bad)

EXAMPLE 2

The procedure for preparation and evaluation of the developers in Example 1 was repeated except that the solid transparent toner image was initially formed on the recording material and then a solid color toner image was formed thereon (i.e., the positions of the transparent toner image and a color toner image are reversed).

EXAMPLE 3

The procedure for preparation and evaluation of the developers in Example 1 was repeated except that the developing devices used for forming transparent toner images and color toner images (i.e., the developing device having such a configuration as illustrated in FIG. 5) were replaced with developing devices, each of which has such a configuration as illustrated in FIG. 8.

Comparative Example 1

The procedure for preparation and evaluation of the developers in Example 1 was repeated except that the developing devices used for forming transparent toner images and color toner images (i.e., the developing device having such a configuration as illustrated in FIG. 5) were replaced with developing devices, each of which has such a configuration as illustrated in FIG. 1.

Comparative Example 2

The procedure for preparation and evaluation of the developers in Example 3 was repeated except that the transparent toner 1 was replaced with the transparent toner 2.

EXAMPLE 4

The procedure for preparation and evaluation of the developers in Example 3 was repeated except that the transparent toner 1 was replaced with the transparent toner 3.

Comparative Example 3

The procedure for preparation and evaluation of the developers in Example 3 was repeated except that the transparent toner 1 was replaced with the transparent toner 4.

Comparative Example 4

The procedure for preparation and evaluation of the developers in Example 3 was repeated except that the transparent toner 1 was replaced with the transparent toner 5.

EXAMPLE 5

The procedure for preparation and evaluation of the developers in Example 3 was repeated except that the transparent toner 1 was replaced with the transparent toner 6.

Comparative Example 5

The procedure for preparation and evaluation of the developers in Example 3 was repeated except that the transparent toner 1 was replaced with the transparent toner 7.

EXAMPLE 6

The procedure for preparation and evaluation of the developers in Example 3 was repeated except that the transparent toner 1 was replaced with the transparent toner 8.

EXAMPLE 7

The procedure for preparation and evaluation of the developers in Example 3 was repeated except that the transparent toner 1 was replaced with the transparent toner 9.

EXAMPLE 8

The procedure for preparation and evaluation of the developers in Example 3 was repeated except that the transparent toner 1 was replaced with the transparent toner 10.

EXAMPLE 9

The procedure for preparation and evaluation of the developers in Example 3 was repeated except that the transparent toner 1 was replaced with the transparent toner 11.

EXAMPLE 10

The procedure for preparation and evaluation of the developers in Example 3 was repeated except that the transparent toner 1 was replaced with the transparent toner 12.

EXAMPLE 11

The procedure for preparation and evaluation of the developers in Example 3 was repeated except that the weight of the solid transparent toner image was changed to 0.05 mg/cm$^2$. In this regard, the thickness of the fixed transparent toner image was 0.5 μm.

EXAMPLE 12

The procedure for preparation and evaluation of the developers in Example 3 was repeated except that the weight of the solid transparent toner image was changed to 0.1 mg/cm$^2$. In this regard, the thickness of the fixed transparent toner image was 2 μm.

EXAMPLE 13

The procedure for preparation and evaluation of the developers in Example 3 was repeated except that the weight of the solid transparent toner image was changed to 1.2 mg/cm$^2$. In this regard, the thickness of the fixed transparent toner image was 14 μm.

EXAMPLE 14

The procedure for preparation and evaluation of the developers in Example 3 was repeated except that the weight of the solid transparent toner image was changed to 1.5 mg/cm$^2$. In this regard, the thickness of the fixed transparent toner image was 16 μm.

EXAMPLE 15

The procedure for preparation and evaluation of the developers in Example 2 was repeated except that the developing devices used for forming transparent toner images and color toner images (i.e., the developing device having such a configuration as illustrated in FIG. 5) were replaced with developing devices, each of which has such a configuration as illustrated in FIG. 8.

EXAMPLE 16

The procedure for preparation and evaluation of the developers in Example 3 was repeated except that the developing devices used for forming transparent toner images and color toner images (i.e., the developing device having such a configuration as illustrated in FIG. 8) were replaced with developing devices, each of which has such a configuration as illustrated in FIG. 5.

EXAMPLE 17

The procedure for preparation and evaluation of the developers in Example 4 was repeated except that the developing devices used for forming transparent toner images and color toner images (i.e., the developing device having such a configuration as illustrated in FIG. 8) were replaced with developing devices, each of which has such a configuration as illustrated in FIG. 5.

EXAMPLE 18

The procedure for preparation and evaluation of the developers in Example 5 was repeated except that the developing devices used for forming transparent toner images and color toner images (i.e., the developing device having such a configuration as illustrated in FIG. 8) were replaced with developing devices, each of which has such a configuration as illustrated in FIG. 5.

EXAMPLE 19

The procedure for preparation and evaluation of the developers in Example 6 was repeated except that the developing devices used for forming transparent toner images and color toner images (i.e., the developing device having such a configuration as illustrated in FIG. 8) were replaced with developing devices, each of which has such a configuration as illustrated in FIG. 5.

EXAMPLE 20

The procedure for preparation and evaluation of the developers in Example 7 was repeated except that the developing devices used for forming transparent toner images and color toner images (i.e., the developing device having such a configuration as illustrated in FIG. 8) were replaced with developing devices, each of which has such a configuration as illustrated in FIG. 5.

EXAMPLE 21

The procedure for preparation and evaluation of the developers in Example 8 was repeated except that the developing devices used for forming transparent toner images and color toner images (i.e., the developing device having such a configuration as illustrated in FIG. 8) were replaced with developing devices, each of which has such a configuration as illustrated in FIG. 5.

EXAMPLE 22

The procedure for preparation and evaluation of the developers in Example 9 was repeated except that the developing devices used for forming transparent toner images and color toner images (i.e., the developing device having such a configuration as illustrated in FIG. 8) were replaced with developing devices, each of which has such a configuration as illustrated in FIG. 5.

EXAMPLE 23

The procedure for preparation and evaluation of the developers in Example 10 was repeated except that the developing devices used for forming transparent toner images and color toner images (i.e., the developing device having such a configuration as illustrated in FIG. 8) were replaced with developing devices, each of which has such a configuration as illustrated in FIG. 5.

EXAMPLE 24

The procedure for preparation and evaluation of the developers in Example 11 was repeated except that the developing devices used for forming transparent toner images and color toner images (i.e., the developing device having such a configuration as illustrated in FIG. 8) were replaced with developing devices, each of which has such a configuration as illustrated in FIG. 5.

EXAMPLE 25

The procedure for preparation and evaluation of the developers in Example 12 was repeated except that the developing devices used for forming transparent toner images and color toner images (i.e., the developing device having such a configuration as illustrated in FIG. 8) were replaced with developing devices, each of which has such a configuration as illustrated in FIG. 5.

EXAMPLE 26

The procedure for preparation and evaluation of the developers in Example 13 was repeated except that the developing devices used for forming transparent toner images and color toner images (i.e., the developing device having such a configuration as illustrated in FIG. 8) were replaced with developing devices, each of which has such a configuration as illustrated in FIG. 5.

EXAMPLE 27

The procedure for preparation and evaluation of the developers in Example 14 was repeated except that the developing devices used for forming transparent toner images and color toner images (i.e., the developing device having such a configuration as illustrated in FIG. 8) were replaced with developing devices, each of which has such a configuration as illustrated in FIG. 5.

The evaluation results are shown in Table 4-1 and 4-2.

TABLE 4-1

| | No. of transparent toner | Developing device used | Outermost toner layer*2 | Thickness of transparent toner layer (μm) |
|---|---|---|---|---|
| Example 1 | 1 | Developing device illustrated in FIG. 5 | T | 7 |
| Example 2 | 1 | Developing device illustrated in FIG. 5 | C | 7 |
| Example 3 | 1 | Developing device illustrated in FIG. 8 | T | 7 |
| Comparative Example 1 | 1 | Developing device illustrated in FIG. 1 | T | 7 |
| Comparative Example 2 | 2 | Developing device illustrated in FIG. 8 | T | 7 |
| Example 4 | 3 | Developing device illustrated in FIG. 8 | T | 7 |

TABLE 4-1-continued

| | No. of transparent toner | Developing device used | Outermost toner layer*2 | Thickness of transparent toner layer (μm) |
|---|---|---|---|---|
| Comparative Example 3 | 4 | Developing device illustrated in FIG. 8 | T | 7 |
| Comparative Example 4 | 5 | Developing device illustrated in FIG. 8 | T | 7 |
| Example 5 | 6 | Developing device illustrated in FIG. 8 | T | 7 |
| Comparative Example 5 | 7 | Developing device illustrated in FIG. 8 | T | 7 |
| Example 6 | 8 | Developing device illustrated in FIG. 8 | T | 7 |
| Example 7 | 9 | Developing device illustrated in FIG. 8 | T | 7 |
| Example 8 | 10 | Developing device illustrated in FIG. 8 | T | 7 |
| Example 9 | 11 | Developing device illustrated in FIG. 8 | T | 7 |
| Example 10 | 12 | Developing device illustrated in FIG. 8 | T | 7 |
| Example 11 | 1 | Developing device illustrated in FIG. 8 | T | 0.5 |
| Example 12 | 1 | Developing device illustrated in FIG. 8 | T | 2 |
| Example 13 | 1 | Developing device illustrated in FIG. 8 | T | 14 |
| Example 14 | 1 | Developing device illustrated in FIG. 8 | T | 16 |
| Example 15 | 1 | Developing device illustrated in FIG. 8 | C | 7 |
| Example 16 | 1 | Developing device illustrated in FIG. 5 | T | 7 |
| Example 17 | 3 | Developing device illustrated in FIG. 5 | T | 7 |
| Example 18 | 6 | Developing device illustrated in FIG. 5 | T | 7 |
| Example 19 | 8 | Developing device illustrated in FIG. 5 | T | 7 |
| Example 20 | 9 | Developing device illustrated in FIG. 5 | T | 7 |
| Example 21 | 10 | Developing device illustrated in FIG. 5 | T | 7 |
| Example 22 | 11 | Developing device illustrated in FIG. 5 | T | 7 |
| Example 23 | 12 | Developing device illustrated in FIG. 5 | T | 7 |
| Example 24 | 1 | Developing device illustrated in FIG. 5 | T | 0.5 |
| Example 25 | 1 | Developing device illustrated in FIG. 5 | T | 2 |
| Example 26 | 1 | Developing device illustrated in FIG. 5 | T | 14 |
| Example 27 | 1 | Developing device illustrated in FIG. 5 | T | 16 |

Outermost toner layer*2

T: The transparent toner layer is the outermost layer.

C: A color toner layer is the outermost layer.

TABLE 4-2

| | Low temp. fixability | Hot offset resistance | Pre-servability | Gloss-iness | Unevenness of glossiness |
|---|---|---|---|---|---|
| Example 1 | ◎ | ◎ | ○ | ◎ | ◎ |
| Example 2 | ◎ | ◎ | ○ | Δ | Δ |
| Example 3 | ◎ | ◎ | ○ | ◎ | ◎ |
| Comparative Example 1 | ◎ | ◎ | ○ | ◎ | X |
| Comparative Example 2 | ◎ | X | X | ◎ | ◎ |
| Example 4 | Δ | ◎ | ○ | ○ | ◎ |
| Comparative Example 3 | X | ◎ | ○ | ○ | ○ |
| Comparative Example 4 | ◎ | X | ○ | ◎ | ○ |
| Example 5 | □ | ◎ | ○ | ○ | ◎ |
| Comparative Example 5 | X | X | ○ | ○ | ○ |
| Example 6 | Δ | ◎ | ○ | Δ | ◎ |
| Example 7 | ○ | ◎ | ○ | ○ | ◎ |
| Example 8 | ◎ | ◎ | ○ | ◎ | ◎ |
| Example 9 | ◎ | ○ | ○ | ◎ | ◎ |
| Example 10 | ◎ | □ | ○ | ◎ | ◎ |
| Example 11 | ◎ | ○ | ○ | Δ | ○ |
| Example 12 | ◎ | ◎ | ○ | ○ | ○ |
| Example 13 | ◎ | ◎ | ○ | ◎ | ◎ |
| Example 14 | ○ | ◎ | ○ | ◎ | ○ |
| Example 15 | ◎ | ◎ | ○ | Δ | Δ |
| Example 16 | ◎ | ◎ | ○ | ◎ | ◎ |
| Example 17 | Δ | ◎ | ○ | ○ | ◎ |
| Example 18 | □ | ◎ | ○ | ○ | ◎ |
| Example 19 | Δ | ◎ | ○ | Δ | ◎ |
| Example 20 | ○ | ◎ | ○ | ○ | ◎ |
| Example 21 | ◎ | ◎ | ○ | ◎ | ◎ |

TABLE 4-2-continued

| | Low temp. fixability | Hot offset resistance | Pre-servability | Gloss-iness | Unevenness of glossiness |
|---|---|---|---|---|---|
| Example 22 | ◎ | ○ | ○ | ◎ | ◎ |
| Example 23 | ◎ | □ | ○ | ◎ | ◎ |
| Example 24 | ◎ | ○ | ○ | Δ | ○ |
| Example 25 | ◎ | ◎ | ○ | ○ | ○ |
| Example 26 | ◎ | ◎ | ○ | ◎ | ◎ |
| Example 27 | ○ | ◎ | ○ | ◎ | ○ |

It is clearly understood from Tables 1-4 that by using the image forming method of the present invention, glossy images can be stably produced at a relatively low fixing temperature for a long period of time without causing the offset problems and without deteriorating the carrier used in combination with the toner.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 2010-155192 and 2011-081534, filed on Jul. 7, 2010, and Apr. 1, 2011, respectively, the entire contents of which are herein incorporated by reference.

What is claimed is:

1. A developing device for developing an electrostatic latent image on an image bearing member, comprising:

a developer bearing member to bear a developer including a transparent toner and a magnetic carrier to develop the electrostatic latent image on the image bearing member with the transparent toner at a development region in which the developer bearing member is opposed to the image bearing member, wherein the transparent toner includes a resin and a lubricant, and has a viscoelastic property such that a loss tangent (tan δ), which is defined as a ratio (G"/G') of loss modulus (G") to storage modulus (G'), has a peak at a temperature of from 80° C. to 160° C. and the peak has a height of not less than 3;

a developer supplying passage having a developer supplying member to feed the developer in a first direction parallel to an axial direction of the developer bearing member to supply the developer to the developer bearing member; and a developer feeding passage having a developer feeding member to feed at least the developer, which has passed through the development region and is fed to the developer feeding passage, in a second direction parallel to the first direction, wherein the developer feeding passage is separated with a partition from the developer supplying passage at least at a central portion thereof in the first and second directions.

2. The developing device according to claim 1, wherein the developer feeding passage includes:

a developer collecting passage having a developer collecting member to feed the developer, which has passed through the development region and is fed to the developer collecting passage, in the first direction; and a developer agitating passage having a developer agitating member to receive the developer, which is fed to a downmost stream side of the developer supplying passage relative to the first direction without being used for developing the electrostatic latent image, and the developer, which is fed to a downmost stream side of the developer collecting passage relative to the first direction, and to feed the received developer in a direction opposite to the first direction while agitating the developer and supplying the agitated developer to the developer supplying passage, wherein the developer supplying passage, the developer collecting passage and the developer agitating passage are separated with the partition from each other at least at central portions thereof, and wherein the developer collecting passage and the developer agitating passage are substantially on a same level in a vertical direction and the developer supplying passage is on a level higher than the level of the developer collecting passage and the developer agitating passage in the vertical direction.

3. The developing device according to claim 1, wherein the developer feeding passage is a developer agitating passage having a developer agitating member to receive the developer, which is fed to a downmost stream side of the developer supplying passage relative to the first direction without being used for developing the electrostatic latent image, and the developer, which has passed through the development region and is fed to the developer agitating passage, to feed the received developer in a direction opposite to the first direction while agitating the developer and supplying the agitated developer to the developer supplying passage, wherein the developer supplying passage and the developer agitating passage are separated with the partition from each other at least at central portions thereof.

4. An image forming method comprising:

developing an electrostatic latent image on a first image bearing member with a first developer, which includes a color toner and a first magnetic carrier and which is contained in a first developing device, to form a color toner image on the first image bearing member;

developing another electrostatic latent image on the first image bearing member or a second image bearing member with a second developer, which includes a transparent toner and the first magnetic carrier or a second magnetic carrier and which is contained in a second developing device to form a transparent toner image on the first or second image bearing member, wherein the second developing device is the developing device according to claim 1;

transferring the color toner image and the transparent toner image onto a recording material to form a combined toner image in which the color toner image and the transparent toner image are partially or entirely overlapped; and fixing the combined toner image on the recording material.

5. The image forming method according to claim 4, wherein the developer feeding passage of the second developing device includes:

a developer collecting passage having a developer collecting member to feed the second developer, which has passed through the development region and is fed to the developer collecting passage, in the first direction; and a developer agitating passage having a developer agitating member to receive the second developer, which is fed to a downmost stream side of the developer supplying passage relative to the first direction without being used for developing the electrostatic latent image, and the second developer, which is fed to a downmost stream side of the developer collecting passage relative to the first direction, and to feed the received second developer in a direction opposite to the first direction while agitating the second developer and supplying the agitated second developer to the developer supplying passage, wherein the developer supplying passage, the developer collecting passage and the developer agitating passage are separated with the partition from each other at least at central portions thereof, and wherein the developer collecting passage and the developer agitating passage are substantially on a same level in a vertical direction and the developer supplying passage is on a level higher than the level of the developer collecting passage and the developer agitating passage in the vertical direction.

6. The image forming method according to claim 4, wherein the developer feeding passage of the second developing device is a developer agitating passage having a developer agitating member to receive the second developer, which is fed to a downmost stream side of the developer supplying passage relative to the first direction without being used for developing the electrostatic latent image, and the second developer, which has passed through the development region and is fed to the developer agitating passage, to feed the received second developer in a direction opposite to the first direction while agitating the second developer and supplying the agitated second developer to the developer supplying passage, wherein the developer supplying passage and the developer agitating passage are separated with the partition from each other at least at central portions thereof.

7. The image forming method according to claim 4, wherein the transparent toner image is present as an outermost layer of the fixed combined toner image on the recording material.

8. The image forming method according to claim 4, wherein the resin of the transparent toner includes a thermoplastic polyester resin, and wherein a ratio (Mw/Mn) of a weight average molecular weight (Mw) of the polyester resin to a number average molecular weight (Mn) thereof is not greater than 6.

9. The image forming method according to claim 4, wherein the resin of the transparent toner includes a thermoplastic crystalline polyester resin.

10. The image forming method according to claim 4, wherein the lubricant of the transparent toner includes a fatty acid amide-based lubricant.

11. The image forming method according to claim 4, wherein the fixed transparent toner image has a thickness of from 1 μm to 15 μm.

12. The image forming method according to claim 4, further comprising:

supplying a first supplementary toner including at least the color toner to the first developing device from a first deformable container using a first sucking pump to suck the first supplementary toner in the first deform-able container; and supplying a second supplementary toner including at least the transparent toner to the second developing device from a second deformable container using a second sucking pump to suck the second supplementary toner in the second deformable container.

13. An image forming apparatus comprising:

at least one image bearing member;

a first developing device to develop an electrostatic latent image on the at least one image bearing member with a first developer including a color toner and a first magnetic carrier to form a color toner image thereon;

a second developing device to develop an electrostatic latent image on the at least one image bearing member with a second developer including a transparent toner and the first magnetic carrier or a second magnetic carrier to form a transparent toner image thereon, wherein the second developing device is the developing device according to claim 1;

a transferring device to transfer the color toner image and the transparent toner image onto a recording material to form a combined toner image in which the color toner image and the transparent toner image are partially or entirely overlapped; and a fixing device to fix the combined toner image on the recording material.

14. A process cartridge comprising:

an image bearing member; and the developing device according to claim 1 to develop an electrostatic latent image on the image bearing member with the developer including the transparent toner and the magnetic carrier to form a transparent toner image thereon, wherein the image bearing member and the developing device are integrated into a single unit so as to be detachably attachable to an image forming apparatus.

* * * * *